US008918030B2

(12) United States Patent
Kimura et al.

(10) Patent No.: US 8,918,030 B2
(45) Date of Patent: Dec. 23, 2014

(54) POWDER SUPPLYING DEVICE AND IMAGE FORMING APPARATUS

(75) Inventors: Hideki Kimura, Yokohama (JP); Eisuke Hori, Tokyo (JP); Nobuo Takami, Kawasaki (JP); Yuji Suzuki, Tokyo (JP); Kenji Kikuchi, Zama (JP)

(73) Assignee: Ricoh Company, Limited, Tokyo (JP)

( * ) Notice: Subject to any disclaimer, the term of this patent is extended or adjusted under 35 U.S.C. 154(b) by 785 days.

(21) Appl. No.: 12/625,922

(22) Filed: Nov. 25, 2009

(65) Prior Publication Data

US 2010/0129118 A1 May 27, 2010

(30) Foreign Application Priority Data

Nov. 27, 2008 (JP) ..... 2008-302686
Sep. 4, 2009 (JP) ..... 2009-204875

(51) Int. Cl.
*G03G 15/08* (2006.01)
*G03G 15/04* (2006.01)

(52) U.S. Cl.
CPC ..... *G03G 15/0839* (2013.01); *G03G 2215/067* (2013.01)
USPC ..... 399/262; 399/260; 399/258; 399/119; 399/120

(58) Field of Classification Search
CPC ..... G03G 2215/0668
USPC ..... 399/258, 260, 262
See application file for complete search history.

(56) References Cited

U.S. PATENT DOCUMENTS 5,568,237 A 10/1996 Ishida et al.
6,505,026 B2 1/2003 Hayakawa et al.
6,826,381 B2 11/2004 Muramatsu et al.
7,043,182 B2 5/2006 Sakai et al.
7,212,773 B2 5/2007 Sudo et al
7,228,093 B2 6/2007 Sakai et al.
7,272,342 B2 9/2007 Nagashima et al.
7,325,908 B2 2/2008 Katoh et al.
7,457,570 B2 11/2008 Kasai et al.
7,540,598 B2 6/2009 Hori et al.

(Continued)

FOREIGN PATENT DOCUMENTS

CN 1217490 A 5/1999
CN 1945458 A 4/2007

(Continued)

OTHER PUBLICATIONS

Office Action issued Jun. 29, 2011 in China Application No. 200910224944.6.

*Primary Examiner* — David Gray
*Assistant Examiner* — Andrew Do
(74) *Attorney, Agent, or Firm* — Oblon, Spivak, McClelland, Maier & Neustadt, L.L.P.

(57) ABSTRACT

A powder supplying device includes a powder container frame, a powder container detachably installable in the powder container frame horizontally and including a container body in which a discharge port through which powder is discharged from the container body is formed, a shutter member attached to the container body to open and close the discharge port by moving along the container body in a direction in which the powder container is installed, and at least one shutter control member movably attached to the powder container frame. The shutter control member opens and closes the shutter member by moving together with the powder container as the powder container is fitted into and pulled out from the powder container frame.

23 Claims, 14 Drawing Sheets

(56) References Cited

U.S. PATENT DOCUMENTS

| | | | | |
|---|---|---|---|---|
| 7,599,650 | B2 | 10/2009 | Katoh et al. | |
| 7,668,489 | B2 * | 2/2010 | Kim et al. | 399/258 |
| 7,702,262 | B2 | 4/2010 | Taguchi et al. | |
| 7,706,699 | B2 | 4/2010 | Taguchi et al. | |
| 7,720,417 | B2 | 5/2010 | Taguchi et al. | |
| 7,822,371 | B2 | 10/2010 | Taguchi et al. | |
| 7,826,777 | B2 | 11/2010 | Taguchi et al. | |
| 7,835,675 | B2 | 11/2010 | Taguchi et al. | |
| 7,853,183 | B2 | 12/2010 | Taguchi et al. | |
| 7,853,184 | B2 | 12/2010 | Taguchi et al. | |
| 7,991,334 | B2 | 8/2011 | Taguchi et al. | |
| 2002/0085857 | A1 | 7/2002 | Kim et al. | |
| 2005/0031374 | A1 | 2/2005 | Nagashima et al. | |
| 2006/0210319 | A1 * | 9/2006 | Katsuyama | 399/260 |
| 2008/0013982 | A1 | 1/2008 | Kimura | |
| 2008/0025743 | A1 | 1/2008 | Hori | |
| 2008/0094458 | A1 | 4/2008 | Bannai et al. | |
| 2008/0205937 | A1 | 8/2008 | Hori et al. | |
| 2009/0022504 | A1 | 1/2009 | Kuwabara et al. | |
| 2009/0047036 | A1 | 2/2009 | Hori et al. | |
| 2009/0214269 | A1 * | 8/2009 | Choi et al. | 399/258 |
| 2011/0008075 | A1 | 1/2011 | Taguchi et al. | |

FOREIGN PATENT DOCUMENTS

| | | | |
|---|---|---|---|
| CN | 101103315 | A | 1/2008 |
| JP | 2002-214898 | A | 7/2002 |
| JP | 2002-268344 | | 9/2002 |
| JP | 2004-287404 | | 10/2004 |
| JP | 2006-084844 | A | 3/2006 |
| JP | 2007-148320 | | 6/2007 |
| JP | 2007-219417 | | 8/2007 |
| JP | 4014335 | | 9/2007 |
| JP | 4249994 | | 1/2009 |

* cited by examiner

POWDER SUPPLYING DEVICE AND IMAGE FORMING APPARATUS

CROSS-REFERENCE TO RELATED APPLICATIONS

This patent specification claims priority from Japanese Patent Applications No. 2008-302686, filed on Nov. 27, 2008 and 2009-204875, filed on Sep. 4, 2009 in the Japan Patent Office, which are hereby incorporated by reference herein in their entirety.

BACKGROUND OF THE INVENTION

1. Field of the Invention

The present invention relates to a powder supplying device including a powder container that is removably installable to a main unit of an image forming apparatus to supply powdered toner that is consumed in an image forming process. The powder supplying device is incorporated in an image forming apparatus such as a copier, a printer, a facsimile machine, a plotter, a multi-function machine, and the like.

2. Discussion of the Background

In general, electrophotographic image forming apparatuses such as copiers, printers, facsimile machines, plotters, multi-function machines including at least two of these functions, or the like include both a development device to develop latent images formed on an image carrier and a toner supplying device to supply toner to the development device from a replaceable toner container.

Certain related-art image forming apparatuses use cylindrical toner containers (toner bottles), in which a discharge port is formed to discharge the toner and a shutter is provided to close the discharge port. More specifically, in one known configuration, a toner bottle (toner cartridge) includes a shutter and a rail. When the toner bottle is rotated after the toner bottle is inserted into a powder supplying device, the shutter is opened by hooking the rail onto a groove provided in the powder supplying device.

However, in the above-described known configuration, the toner container can move (rotate) only enough to open and close the shutter. The problem is that this limited range of movement also makes it difficult to set the toner container to the powder supplying device. In addition, it might be difficult for users to know whether the toner container is properly set to the powder supplying device. Moreover, because the rail (shutter control member) is provided in the toner bottle, the sizes of the toner bottle and the toner supplying device are increased, which is not desirable.

Accordingly, there is a need to improve usability of the toner containers and to make the toner bottle more compact.

SUMMARY OF THE INVENTION

In view of the foregoing, one illustrative embodiment provides a powder supplying device that includes a powder container frame in which a powder container (toner bottle) is detachably installed horizontally. The powder container includes a container body having a discharge port through which powder is discharged from the bottle body, a shutter member attached to the bottle body to open and close the discharge port by moving along the bottle body in a direction in which the powder container is installed, and at least one shutter control member rotatably attached to the powder container frame. The shutter control member opens and closes the shutter member by rotating simultaneously when the toner bottle is fitted into and pulled out from the powder container frame.

Another illustrative embodiment provides an image forming apparatus having an image carrier to carry a latent image, a development device to develop the latent image formed on the image carrier with toner into a toner image, a transfer device to transfer the toner image from the image carrier onto a recording medium, a fixing device to fix the toner image on the recording medium with heat and pressure, and a powder supplying device as described above.

BRIEF DESCRIPTION OF THE DRAWINGS

A more complete appreciation of the disclosure and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
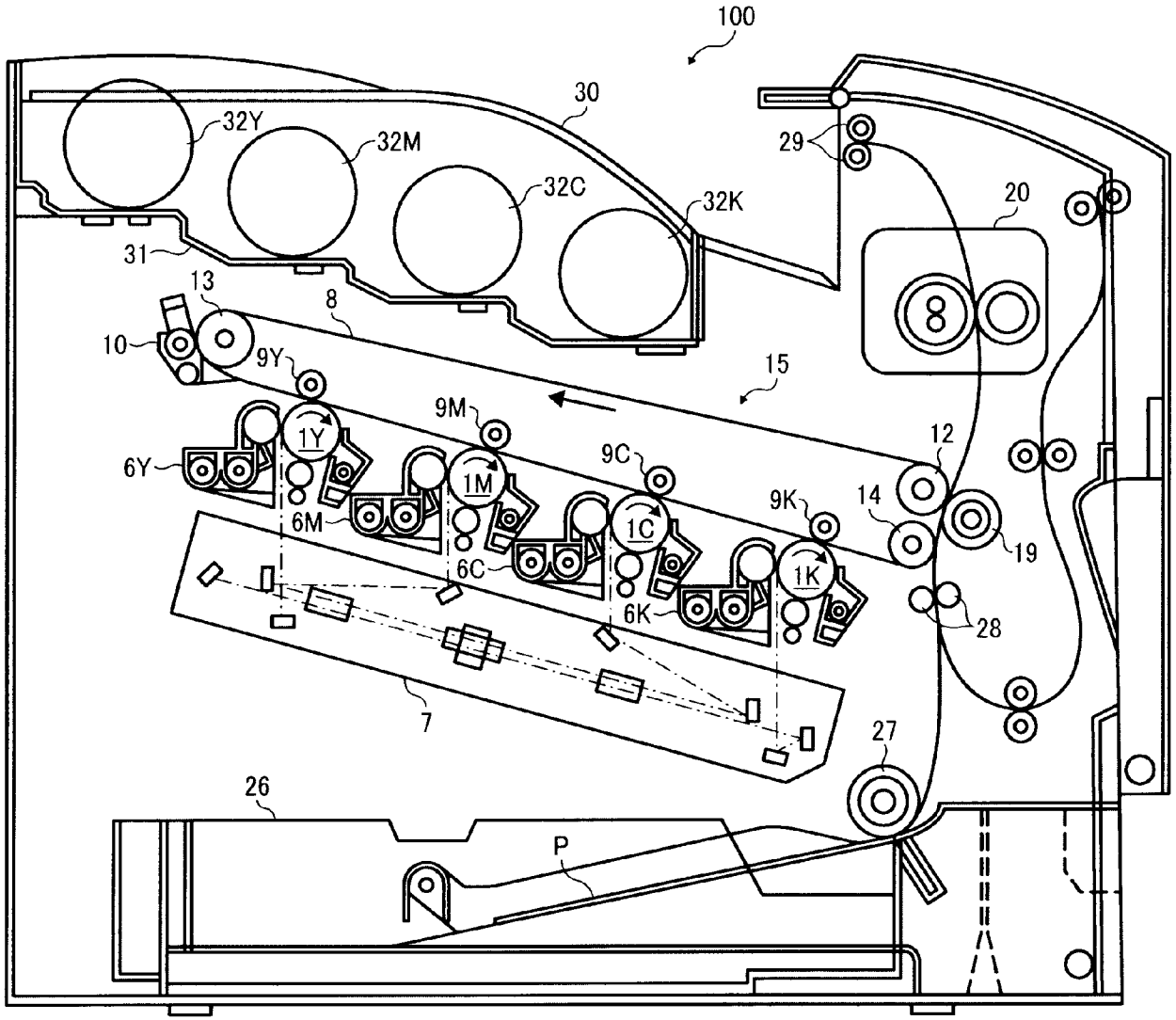
FIG. 1 is a schematic diagram illustrating a configuration of an electrophotographic image forming apparatus according to an illustrative embodiment.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

(First Embodiment)

Referring now to the drawings, wherein like reference numerals designate identical or corresponding parts throughout the several views thereof, and particularly to FIG. 1, an image forming apparatus that is an electrophotographic printer (hereinafter referred to as a printer) according to an illustrative embodiment of the present invention is described. It is to be noted that although the image forming apparatus of the present embodiment is a printer, the image forming apparatus of the present invention is not limited to a printer.

Further, an image forming unit is described as a process cartridge. FIG. 1 is a schematic diagram illustrating a configuration of an electrophotographic printer 100, and FIG. 2 shows a schematic configuration of a process cartridge 6Y for producing yellow toner images.

Initially, a basic configuration of the printer 100 is described below.

The printer 100 includes four process cartridges 6K, 6M, 6C and 6Y as the image forming units for forming black, magenta, cyan, and yellow (hereinafter also simply "Y, M, C, and Y") single-color toner images, respectively.

It is to be noted that the subscripts K, M, C, and Y attached to the end of each reference numeral indicate only that components indicated thereby are used for forming yellow, magenta, cyan, and black images, respectively. However, each process cartridge 6K, 6M, 6C, and 6Y has a similar configuration except for the color of toner used therein as an image forming material. The each process cartridge is replaced when the process cartridge comes to the end of its useful life.

Using the process cartridge 6Y as an example, the configurations of the process cartridges 6K, 6M, 6C, and 6Y are described below.

As shown in FIG. 2, the process cartridge 6Y includes a drum shaped photoreceptor 1Y, a drum cleaning device 2Y, a discharging device, not shown, a charging device 4Y, and a development device 5Y.

The process cartridge 6Y is removably installable to the printer 100, and thus consumable items can be replaced all at one time in the printer 100.

The charging device 4Y uniformly charges the outer circumferential surface of the photoreceptor 1Y that is rotated clockwise in FIG. 2 by a drive member, not shown.

The surface of the photoreceptor 1Y thus uniformly charged is exposed and scanned by a laser light L, after which it then carries an electrostatic latent image for yellow. The electrostatic latent image for yellow is developed into a Y toner image by the development device 5Y that uses the Y toner.

Figure 2:
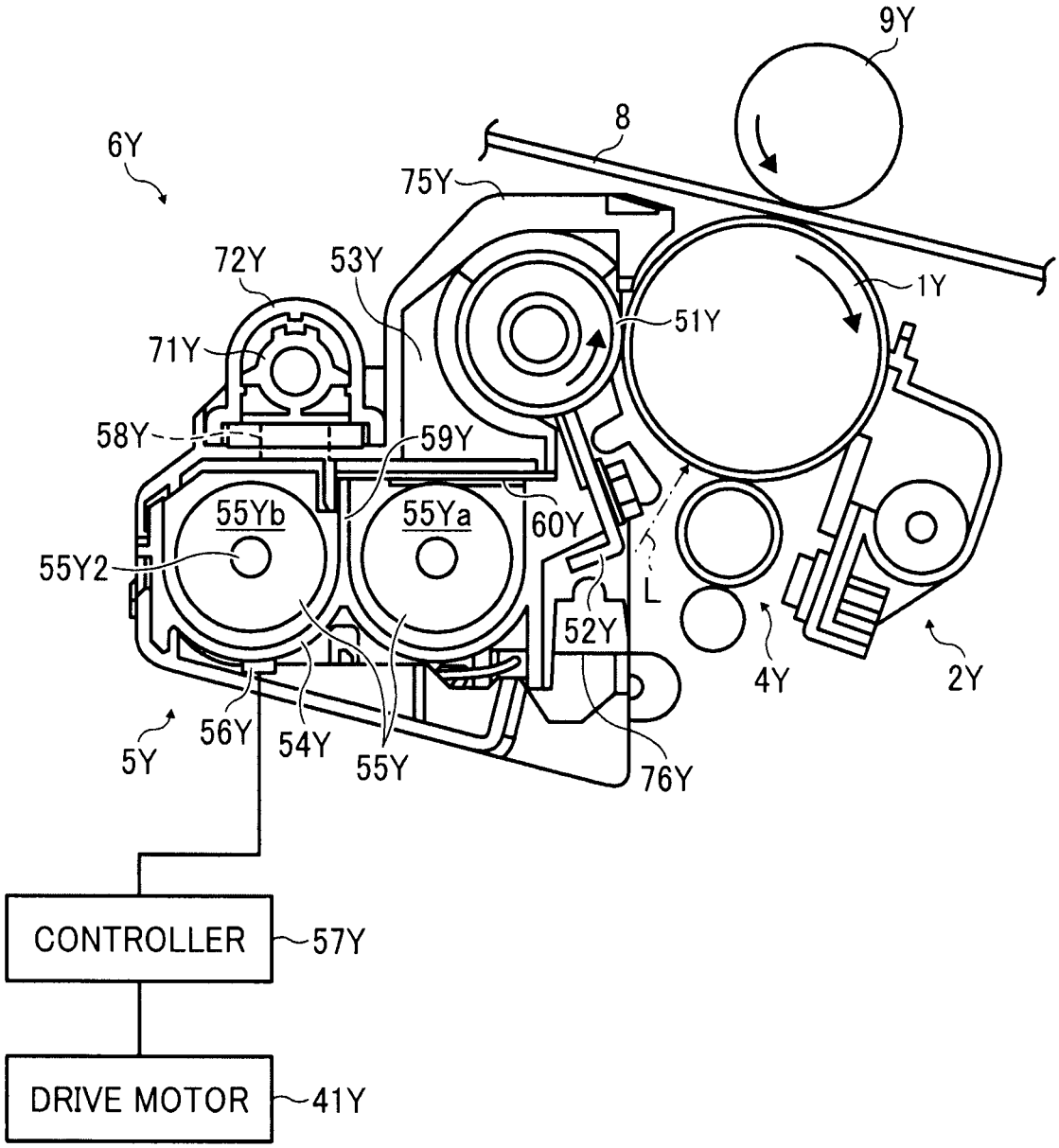
FIG. 2 shows a schematic configuration of a process cartridge for producing yellow toner images in the image forming apparatus shown in FIG. 1.

Then, the yellow toner image is transferred onto an intermediate transfer belt 8 shown in FIG. 1 in an intermediate transfer process.

The drum cleaning device 2Y removes residual toner remaining on the surface of the photoreceptor 1Y after the intermediate transfer process. The discharge device (not shown) discharges the residual charge on the surface of photoreceptor 1Y after the above-described cleaning process. Thus being discharged, the surface of photoreceptor 1Y is initialized, and thereafter, the printer 100 is readied for the next image forming process. Other process cartridge 6M, 6C, and 6K, similarly to the above description, respectively form magenta, cyan, and black toner images on the photoreceptor drums 1M, 1C, and 1K, and then the toner images thereon are initially transferred onto the intermediate transfer belt 8.

As shown in FIG. 1, beneath the process cartridges 6Y, 6M, 6C, and 6K, an exposure device 7 is disposed. The exposure device 7 includes laser light sources, not shown, such as laser diodes that irradiate the respective photoreceptor drums 1 in the process carriages 6 with the laser beams L in accordance with image data.

Due to this exposure process, electrostatic latent images for Y, M, C, and K are respectively formed on the photoreceptor drums 1. In the exposure device 7 the laser beams L emitted from the laser light source are deflected by a polygon mirror driven by a motor, not shown, so that the laser beams L scan the surfaces of photoreceptors 1 via multiple optical lenses and mirrors.

Beneath the exposure device 7, a feeding mechanism that includes a transfer-sheet cassette 26, a feed roller 27 incorporated in the transfer-sheet cassette 26, and a pair of registration rollers 28 is disposed. The transfer-sheet cassette 26 contains a stack of the multiple transfer sheets P, serving as recording media, and the feed roller 27 contacts the transfer sheet P on the top. When the feed roller 27 is rotated counterclockwise in FIG. 1, by a drive member, not shown, the transfer sheet P on the top is fed toward and between the registration rollers 28.

The pair of the registration rollers 28 rotates to sandwich the transfer sheet P and stops rotating soon after sandwiching the transfer sheet P therebetween. Then, the registration rollers 28 send the transfer sheet P to a secondary transfer nip at an appropriate timing.

In the feeding device configured as described above, the feeding roller 27 and the registration roller 28, serving as a timing roller, together form a transporting mechanism. The transporting mechanism transports the transfer sheet P from the transfer-sheet cassette 26 to the secondary transfer nip.

Above the process cartridge 6 in FIG. 1, an intermediate transfer device 15 that includes the intermediate transfer belt 8 extended around the intermediate transfer device 15 is disposed. The intermediate transfer belt 8 serves as an intermediate transfer member. The intermediate transfer unit 15 further includes four primary transfer rollers 9Y, 9M, 9C, and 9K, and a cleaning device 10.

Additionally, in the intermediate transfer unit 15, a secondary transfer backup roller 12, a cleaning backup roller 13, and a tension roller 14 are disposed. The intermediate transfer belt 8 that is a seamless belt extended around the above-described three rollers is rotated counterclockwise in FIG. 1 by rotating at least one of the rollers.

The intermediate transfer belt 8 is sandwiched between the primary transfer bias rollers 9Y, 9M, 9C, and 9K and the photoreceptors 1Y, 1M, 1C, and 1K to form respective primary transfer nips therebetween. Each primary transfer bias roller 9 applies transfer bias that has a reverse polarity (e.g., positive polarity) to the polarity of the toner to a back side (inner circumferential face) of the intermediate transfer belt 8.

All the above-described rollers, except the primary transfer rollers 9, are electrically grounded.

While a surface (outer circumferential surface) of the intermediate transfer belt 8 is moved through the primary transfer nip for yellow, magenta, cyan, and black, the Y, M, C, and K toner images on the photoreceptor drums 1Y, 1M, 1C, and 1K are primarily transferred and superimposed one on another onto the surface of intermediate transfer belt 8. Therefore, a four-color superimposed toner image (hereinafter referred to as a four-color toner image) is formed on the surface of intermediate transfer belt 8.

The intermediate transfer belt 8 is sandwiched between the secondary transfer backup roller 12 and a secondary transfer roller 19, and the secondary transfer nip is formed therebetween. The four-color toner image formed on the intermediate transfer belt 8 is transferred to the transfer sheet P at the secondary transfer nip.

Residual toner that is not transferred onto the transfer sheet P but adheres to the surface of the intermediate transfer belt 8 after the intermediate transfer belt 8 has passed through the transfer nip N2 is removed therefrom by the cleaning device 10.

At the secondary transfer nip, as the transfer sheet P is sandwiched between the intermediate transfer belt 8 and the secondary transfer roller 19 both rotating in a forward direction, the transfer sheet P is transported in a direction away from the registration rollers 28. The four-color toner image is fixed on the surface of the transfer sheet P with heat and pressure while the transfer sheet P passes through the rollers in the fixing device 20 after passing through the secondary transfer nip.

Thereafter, the transfer sheet P is discharged outside of the printer 100 via a pair of discharging sheet rollers 29.

A stack portion 30 is located on the top side of the printer 100. The transfer sheets P discharged outside by the pair of discharge sheet rollers 29 are sequentially stacked on the stack portions 30. It is to be noted that, beneath the stack portion 30, a bottle frame 31 is disposed, and the bottle frame 31 contains four toner bottles 32Y, 32M, 32C, and 32K.

Next, a configuration of the development device 5Y in the process cartridge 6Y is described below, with reference to FIG. 2.

The development device 5Y includes a development roller 51Y and a doctor blade 52Y. The development roller 51Y includes a magnetic field generator inside and serves as a developer carrier, with a two-component developer containing magnetic particles (e.g., magnetic carrier) and the toner on its surface. The doctor blade 52Y serves as a developer regulator that regulates a layer thickness of the developer carried and transported on the development roller 51Y.

The development roller 51 is contained in an upper container portion 53Y, and the developer (toner) is contained in a lower container portion 54Y. The lower container portion 54Y is provided with toner screw conveyors 55Y (a first screw conveyor 55Ya and a second screw conveyor 55Yb) that agitate and convey the toner, and a toner supply port 58Y through which the toner is supplied from the toner bottle 32Y set to the lower container portion 54Y is formed in the lower container portion 54Y. The lower container portion 54Y is partially but not completely separated by a partition wall 59Y into a first lower chamber 54Ya and a second lower chamber 54Yb, and the first lower chamber 54Ya is connected to the second lower chamber 54Yb via communication passages A and B (shown in FIG. 3).

Above the toner supply port 58Y, a shutter 71Y to close the toner supply port 58Y and a toner supply port case 72 to cover the toner supply port 58Y are disposed. The development device 5Y is entirely surrounded by an upper casing 75Y that includes an interior wall of the upper container portion 53Y and a lower casing 76Y that includes an interior wall of the lower container portion 54Y.

Further, a toner concentration sensor 56Y is disposed on a lower outer wall of the second lower chamber 54Yb to detect toner concentration of the developer therein. When the sensor 56Y detects that the toner concentration in the second lower chamber 54Yb is diminished, in accordance with a supply signal, a controller 57Y rotates a drive motor 41Y. Then, the toner bottle 32Y (shown in FIG. 1) is rotated, and the toner is supplied to the second lower chamber 54Yb.

Next, toner conveying devices are described below with reference to FIGS. 3A, 3B, and 4.

Figure 3A:
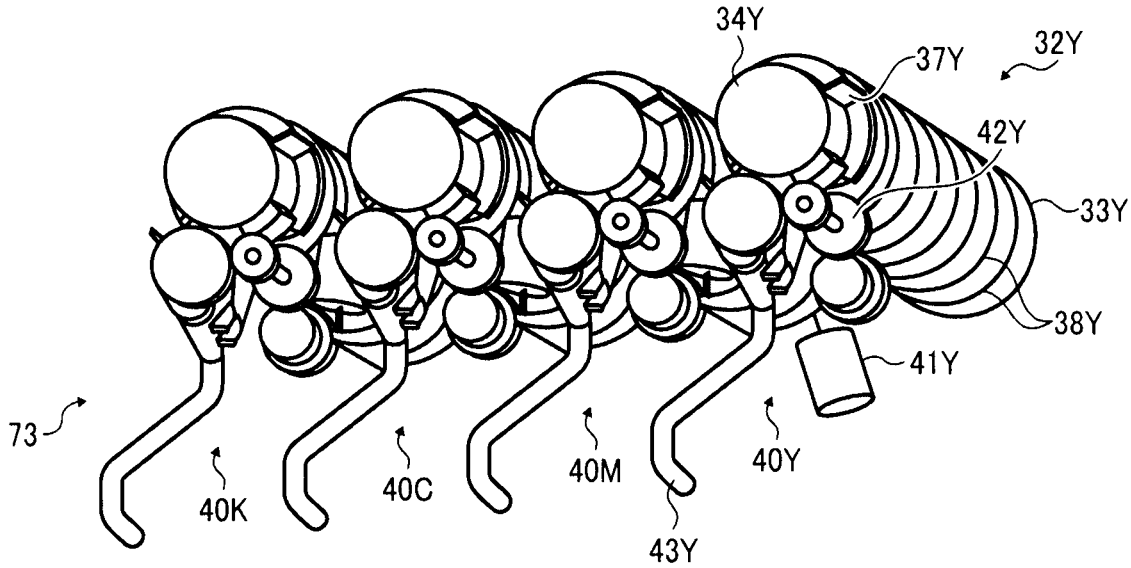
FIG. 3A is a perspective view illustrating a toner supplying device including four toner conveying devices and toner bottles.
Figure 3B:
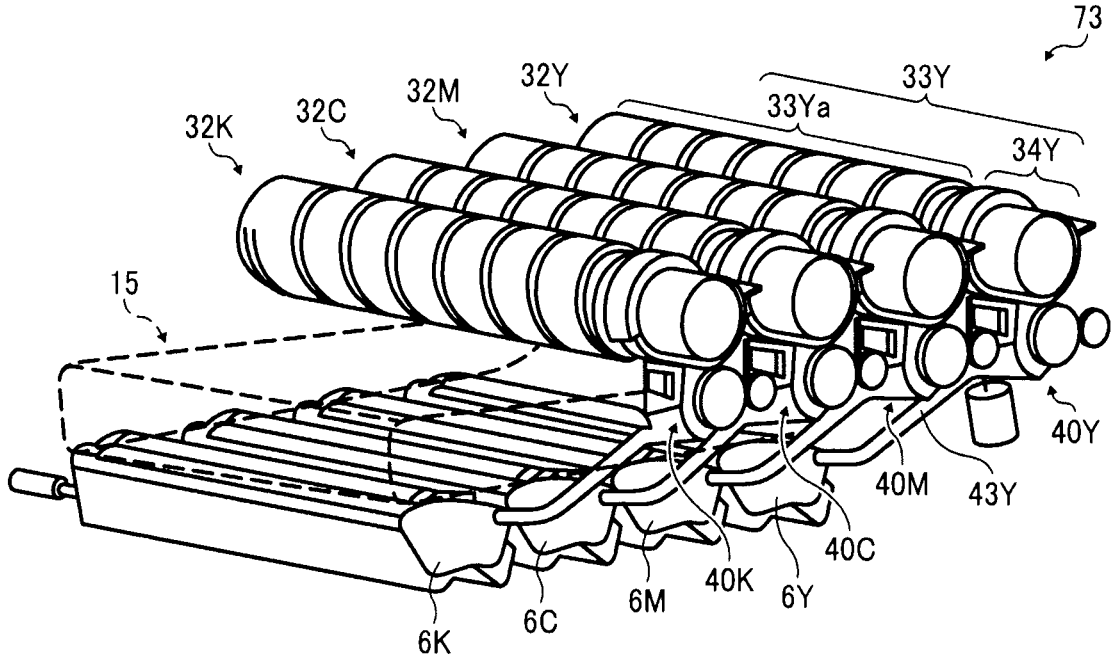
FIG. 3B is another perspective view illustrating the toner supplying device shown in FIG. 3A and the process cartridge.

FIGS. 3A and 3B are perspective views illustrating a toner supplying device 73 including four toner conveying devices 40Y, 40M, 40C, and 40K and the toner bottle frame 31 (shown in FIG. 1), with the toner bottle frame 31 not shown for simplicity. FIGS. 3A and 3B illustrate the toner bottles 32Y, 32M, 32C, and 32K and the four toner conveying devices 40Y, 40M, 40C, and 40K viewed from different angles. FIG. 4 is a perspective view illustrating the toner bottles 32Y, 32M, 32C, and 32K set in the bottle frame 31.

The toner conveying devices 40Y, 40M, 40C, and 40K each including a driving motor 41, a driving gear 42, and a toner conveying tube 43 provided in the printer 100, to one side of the intermediate transfer device 15. Therefore, it is not necessary to provide a toner conveying device either in the process cartridge 6K, 6M, 6C, and 6Y or in the four toner bottles 32Y, 32M, 32C, and 32K, and thus, the process cartridges and toner bottles (powder container) can be made more compact.

In conventional image forming apparatuses, design flexibility is limited because the process cartridges and toner bottles are arranged adjacent to each other.

By contrast, in the present embodiment, the process cartridges 6 and the toner bottles 32 can be separated, thus improving design flexibility and enabling the printer to be made more compact.

Furthermore, respective discharge ports B (shown in FIG. 5) of the toner bottles 32Y, 32M, 32C, and 32K, the toner conveying devices 40Y, 40M, 40C and 40K, and toner supply ports 58 of the lower container portion 54Y, 54M, 54C, and 54K are disposed to the side of one end of the intermediate transfer device 15. Therefore, a toner conveyance route through which toner is conveyed in the toner transport members 40 can be shortened, and the printer can be made more compact. Moreover, clogging during the toner conveyance can be prevented.

Each of the toner conveying devices 40Y, 40M, 40C and 40K has the same basic configuration, differing only in the color of toner used therein as an image forming material. Using the toner conveying device 40Y purely as an example, the configuration of the toner conveying device 40Y, 40M, 40C, and 40K is described in further detail below. It is to be noted that all the toner conveying devices 40Y, 40M, 40C and 40K function in the same way.

In FIG. 3A, the toner conveying device 40Y includes the driving motor 41Y, the driving gear 42Y, and the toner conveying tube 43Y. A resin coil, not shown, is provided in the toner conveying tube 43Y. The driving gear 42Y engages a gear 37Y in the toner bottle 32Y such that, when the drive motor 41Y rotates, a rotary portion 33Ya that is a part of a bottle body 33Y rotates integrally with the gear 37 in the toner bottle 32Y via the driving gear 42Y.

Then, when the toner concentration sensor 56Y of the development device 5Y detects that the concentration of toner in the developer container 54Y is insufficient, the drive motor 51Y rotates in accordance with a supply signal from the controller 57Y.

In FIG. 3A, a spiral-shaped developer guide groove 38Y is formed in an inner surface of the bottle body 33Y. As the rotation portion 33Ya rotates, the toner inside the bottle body 33Y is conveyed from the back end side of the bottle body 33Y toward the front end side at a resin case 34Y by the spiral-shaped developer guide groove 38Y. As a result, the toner inside the bottle body 33Y drops into a toner catcher, not shown, through a discharge port B formed in the resin case 34Y. The toner catcher is connected to the toner transport tube 43Y. When the driving motor 41Y rotates, the resin coil (not shown) in the bottle conveying tube 43Y is rotated as the rotary portion 33Ya rotates. Rotation of the resin coil conveys the toner dropped into the toner catcher to the toner supply port 58Y (shown in FIG. 2) in the developer container 54Y through the toner conveying tube 43Y, thereby adjusting the concentration of toner in the development device 5Y.

It is to be noted that, instead of using the toner concentration sensor 56Y, a reference image may be formed on the photoreceptor 1Y, an optical sensor or a charge coupled device (CCD) to measure the image pixel amount may be provided, and the toner may be supplied base on measurements taken by the optical sensor or CCD.

Figure 4:
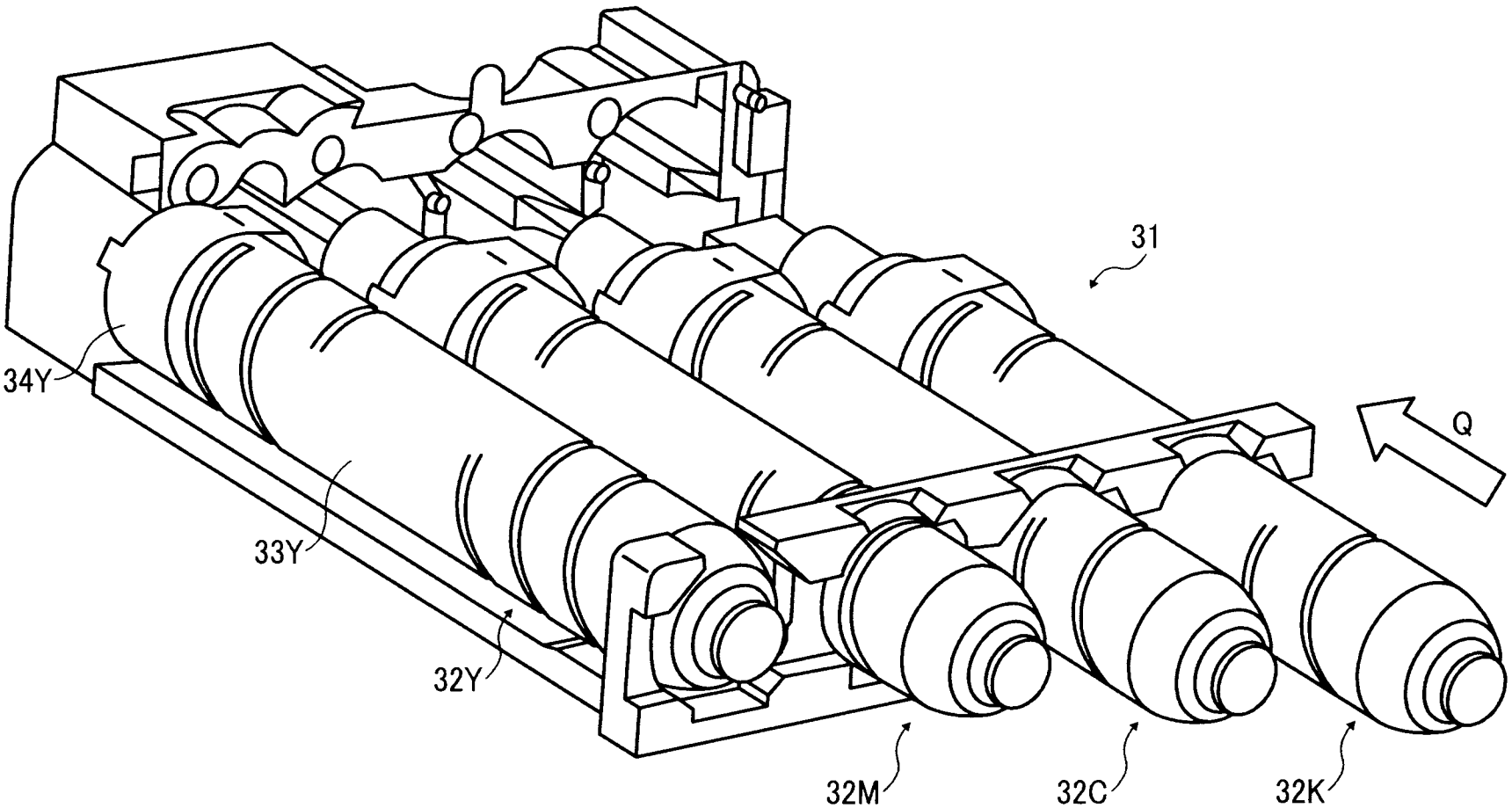
FIG. 4 is a perspective view illustrating the toner bottles set in a toner bottle frame included in the toner supplying device shown in FIG. 3A.

In FIG. 4, the toner bottles 32 are inserted into a holder 81 of the bottle frame 31 in the toner supplying device 73 horizontally in a direction indicated by an arrow Q (hereinafter "direction of insertion").

A shutter mechanism to open and close the toner discharge port B of the toner bottle and its control are described below, with reference to FIGS. 5 through 9.

Figure 5:
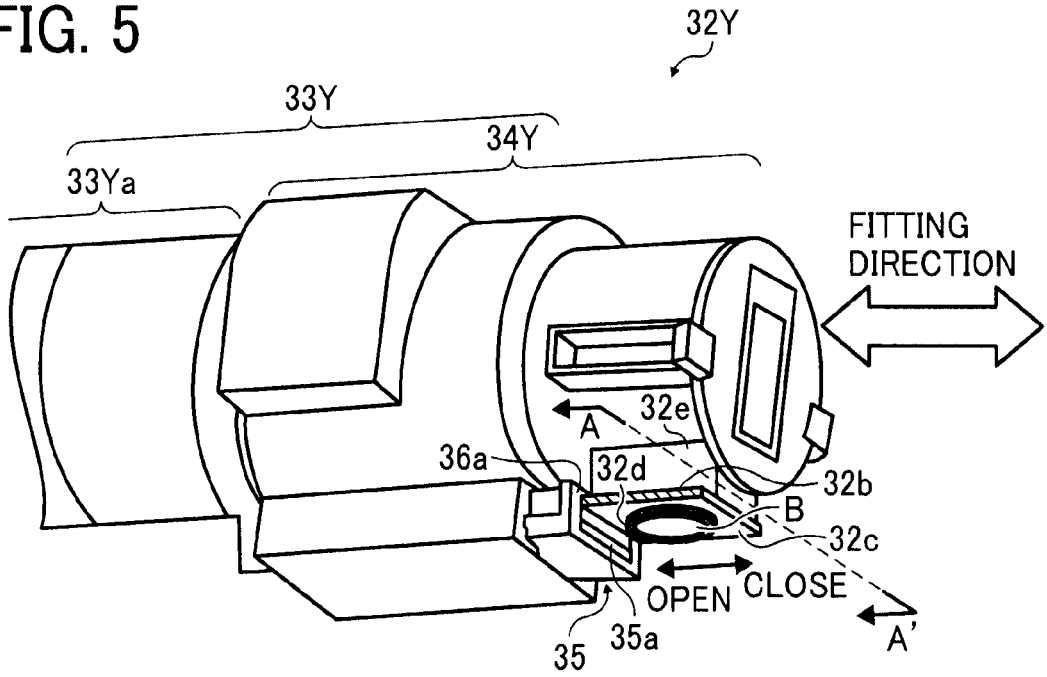
FIG. 5 is a schematic diagram illustrating a bottom of the toner bottle shown in FIG. 4 when a shutter member of the toner bottle is opened.
Figure 6:
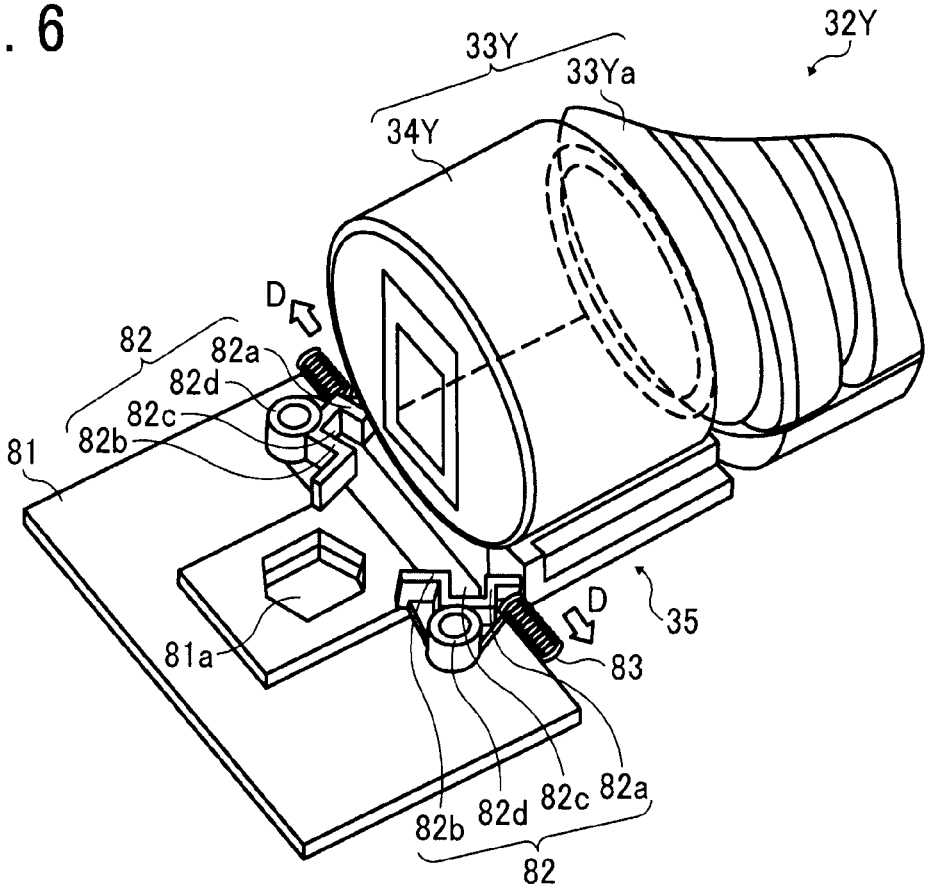
FIG. 6 is a schematic diagram illustrating a configuration of a pair of shutter control members and the vicinity of a resin case of the toner bottle shown in FIG. 4.
Figure 7:
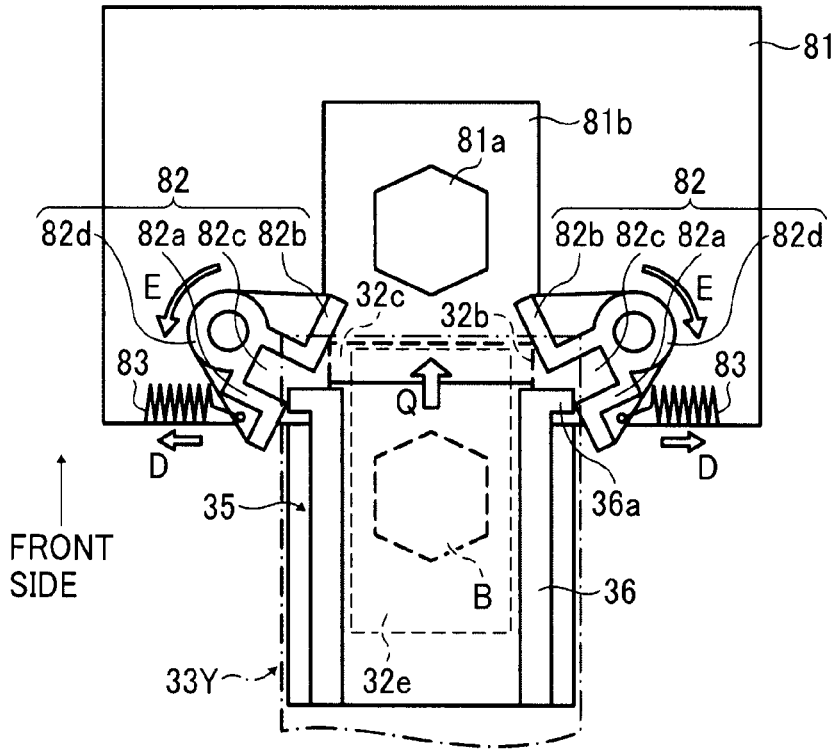
FIG. 7 is a plan view illustrating a state in which a part of the toner bottle shown in FIG. 4 contacts the shutter control members.
Figure 8:
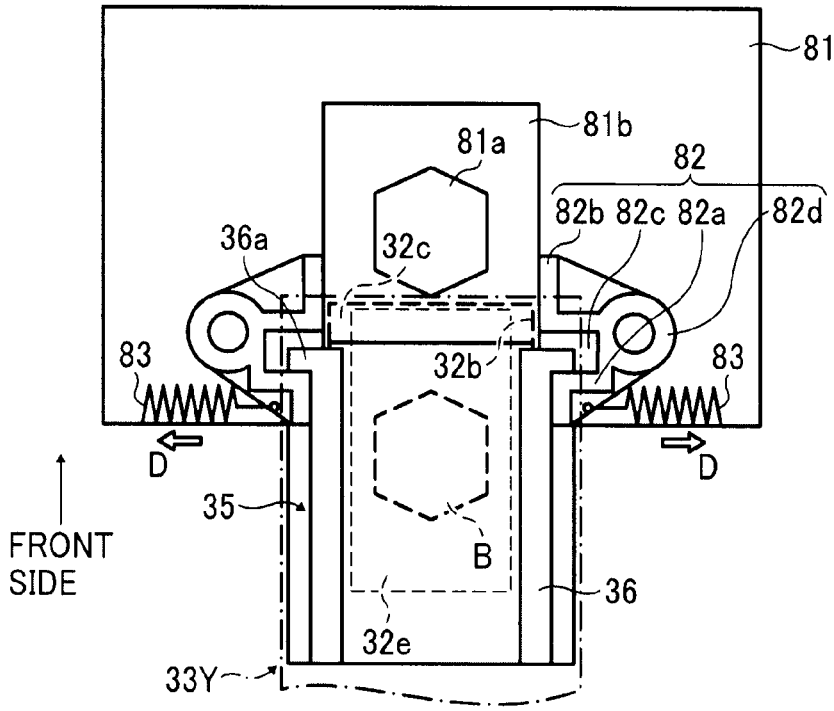
FIG. 8 is a plan view illustrating insertion of the toner bottle into a holder in the bottle frame shown in FIG. 4.
Figure 9:
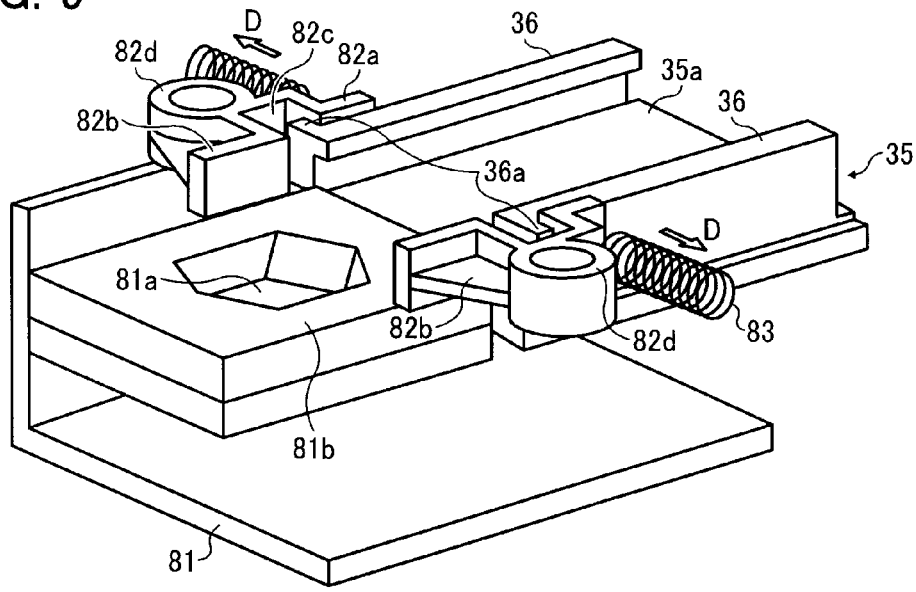
FIG. 9 is a schematic diagram illustrating a configuration around the holder that includes the shutter control members shown in FIG. 6.

FIG. 5 is a schematic diagram illustrating a bottom of the toner bottle 32Y when a shutter member 35 of the toner bottle 32Y is opened. FIG. 6 is a schematic diagram illustrating a configuration of a pair of shutter control members 82 and the vicinity of the resin case 34Y of the toner bottle 32Y. FIG. 7 is a plan view illustrating a state in which a part of the toner bottle 32Y contacts the shutter control members 82 (hereinafter "initial state"). FIG. 8 is a plan view illustrating insertion of the toner bottle 32Y into a holder 81 in the bottle frame 31 (powder container frame). FIG. 9 is a schematic diagram illustrating a configuration of the vicinity of the holder 81 that includes the shutter control members 82.

The toner bottle 32Y includes the bottle body 33Y serving as a container body and the shutter member 35 that moves along a longitudinal direction of the bottle body 33Y. The bottle body 33Y includes the resin case 34Y and the rotary portion 33Ya. The resin case 34Y serves as a handle (hereinafter also "handle 34Y") of the toner bottle 32 and connects to one end portion of the rotary portion 33Ya. The shutter member 35 to open and close the toner discharge port B includes a sponge 35*a* bonded to an inner surface (upper surface) of the shutter member 35, and is located in a lower side of the handle 34Y in the toner bottle 32Y. The shutter member 35 is moved in the longitudinal direction of the bottle body 33Y, that is, the direction of insertion and the opposite direction of the toner bottle 32Y. The toner discharge port B is formed in one end portion of the bottom surface of the bottle body 33Y, in the lower surface of the handle 34Y.

As shown in FIGS. 7 through 9, the shutter member 35 includes a shutter rail 36 that engage a guide groove (not shown) that extends in the longitudinal direction of the bottle body 33Y. The shutter member 35 is movably guided by the shutter rail 36 in the direction of insertion independently of the bottle body 33Y, that is, it can slide in the longitudinal direction relative to the bottle body 33Y.

A rail projection 36*a* is provided in an end portion of the shutter rail 36 in the direction of insertion of the toner bottle 32Y. The rail projection 36*a* projects outward from the end portion of the shutter rail 36 and is engaged with a recess 82*c* (shown in FIG. 6, described in detail below) of each shutter control member 82. That is, each shutter control member 82 includes the recess 82*c* that keeps the toner bottle 32 inserted in the bottle frame 31 by holding onto the rail projection 36*a* that is a part of the shutter member 35 when toner bottle 32Y is fully installed.

The toner bottle 32Y, serving as a powder container, is described below.

As shown in FIG. 5, the toner bottle 32Y is fitted horizontally into the bottle frame 31 (powder container frame), and toner drops from the discharge port B that is formed in the bottom surface of the toner bottle 32Y. When the shutter member 35 closes, a rib 32*d* provided around the discharge port B contacts the sponge 35*a*, and therefore, the toner discharge port B can be reliably sealed. The discharge port B and the rib 32*d* together form a supply portion 32*c*.

FIG. 6 shows a state in which the handle 34Y of the toner bottle 32Y faces the holder 81 attached to the bottle frame 31 (shown in FIG. 4). A supply port 81*a* is formed in the holder 81. The holder 81 rotatably holds center portions of the respective shutter control members 82. Each shutter control member 82 includes a short arm (first arm) 82*a* that is pulled by one of pulling springs 83 in a direction indicated by arrow D, a wide long arm (second arm) 82*b* that contacts a side of the toner bottle 32Y, and a rotary shaft 82*d* disposed in a center portion thereof. The pair of shutter control members 82 is rotatable against pulling force of each pulling spring 83 when the toner bottle 32Y is inserted into the holder 81, and the shutter control members 82 are provided so as to sandwich the handle 34Y of the toner bottle 32Y therebetween. The short arm 82*a* and the long arm 82*b* form a single integrated unit. The long arms 82*b* maintain their rotation angle, respectively, contacting the two sides of the bottle body 33Y, when the toner bottle 32Y is fully inserted into the holder 81. That is, the shutter control members 82 opens the shutter member 35 by moving together with the toner bottle 32Y as the bottle body 33Y is installed.

It is to be noted that, although the arm to be pressed by the spring is shorter and the other arm is longer in the present embodiment, the relative length thereof can be reversed or both arms can be the same length.

The shutter control members 82 are arranged along an insertion route though which the toner bottle 32Y is installed so as not to disturb insertion of the toner bottle 32Y into the holder 81 (bottle frame 31).

More specifically, referring to FIG. 7, when the handle 34Y of the toner bottle 32Y is not installed into the bottle frame 31 (hereinafter "reset state"), each long arms 82*b* projects into the insertion route of the toner bottle 32Y (shutter member 35), pressed by the pulling spring 83 in a direction indicated by an arrow D, one end of which is fixed on the holder 81. While the toner bottle 32Y is inserted into the bottle frame 31 (attaching position), a tip portion of the long arm 82*b* of each shutter control member 82 contacts a tip corner as well as both side surfaces of the shutter member 35 provided on the bottom surface of the toner bottle 32Y. As the toner bottle 32Y is inserted further into the bottle frame 31, the long arm 82*b* rotates outward (in a direction indicated by an arrow E) against the force of the pulling spring 83 to allow insertion of the toner bottle 32Y.

After the toner bottle 32Y is fully inserted into the bottle frame 31, the long arms 82*b* are disengaged from the shutter member 35 and contact the respective sides of the bottle body 33Y, and then, the shutter control members 82 maintain their rotation angle.

As for a pressing member to press the long arm 82*b*, although the pulling spring is used in the present embodiment, alternatively, other types of pressing members can be used.

Next, a series of operations of the shutter control member 82 and shutter member 35 while the toner bottle 32Y is set (hereinafter a "set state") is described below.

FIG. 7 is a plan view illustrating a state in which a part of the toner bottle 32Y contacts the shutter control members 82. FIGS. 7, 8, 10, 11, 12, 13, and 14 are also horizontal cross section views around the toner bottle 32Y along line A-A' shown in FIG. 5. In FIGS. 7, 8, 10, 11, 12, 13, and 14, a smaller dashed rectangle indicates an outline of a supporting member 32*e* that connects the bottle body 33Y and the supply portion 32*c* together and moves along the shutter rail 36, a bold dashed line indicates an outline of the supply portion 32*c* that slides between the shutter rail 36 and the sponge 35*a*, and outside alternate long and short dashed lines indicate an outline of the bottle body 33Y (handle 34Y) that move above the shutter member 35.

When the user inserts the toner bottle 32Y into the bottle frame 31, as described above with reference to FIG. 7, pressed by the side surfaces of the shutter member 35, the long arms 82*b* of the shutter control members 82 are rotated outward against the pressing force of the pulling spring 83, and coincidentally, the short arms 82*a* are rotated. At this time, although the long arms 82*b* rotate outward, the short arms 82*a* rotate inward.

When toner bottle 32Y is further inserted forward, that is, in the direction of insertion (indicated by an arrow Q shown in FIG. 8), the long arms 82*b* of the shutter control members 82 are angled along side faces of the supply portion 32*c*, and the shutter control members 82 stop rotating. Then, the rail projection 36*a* of each shutter member 35 is sandwiched in a recess 82*c* formed by the short arm 82*a* and the long arm 82*b*. A given clearance may be kept between the rail projection 36*a* and the short arm 82*a* and the long arm 82*b* sandwiching the rail projection 36*a* therebetween. The recess 82*c* of the shutter control member 82 may have any shape that can hold the rail projection.

Referring to FIG. 9, it can be seen that the present embodiment is designed so that, when the shutter control members 82 stop rotating and the rail projection 36*a* is held in the recess 82*c* of the shutter control member 82, the shutter member 35 contacts a part of the holder 81 provided in the main body of the printer 100. Further, at this time, the long arms 82*b* are restrained from rotating by contacting the respective sides of the bottle body 33Y.

It is to be noted that, in the present embodiment, the phrase "the shutter 35 contacts a part of the holder 81" means that the sponge 35*a* provided on the shutter member 35 contacts a seal member 81*b* provided in the holder 81. Additionally, the lengths of the sponge 35*a* and the seal member 81*b* are set so that the sponge 35*a* and the seal member 81*b* at least partly overlap.

Figure 10:
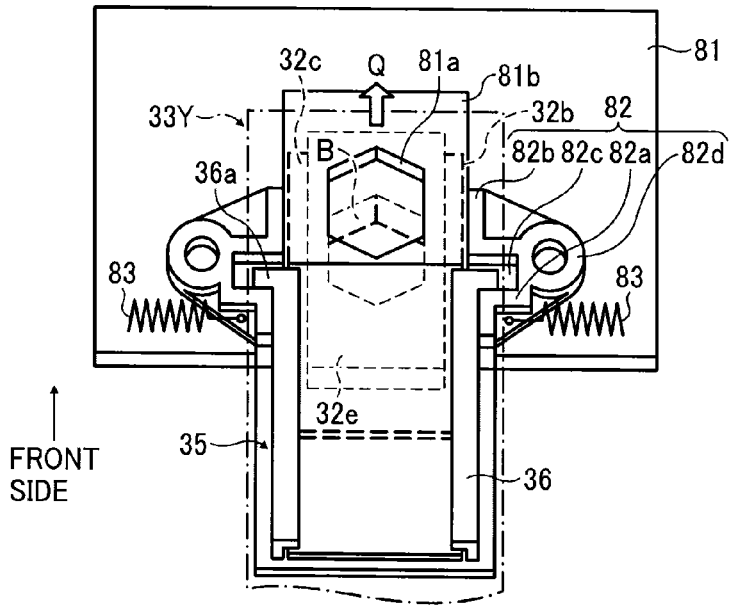
FIG. 10 is a plan view illustrating a state in which the toner bottle is further pressed into the holder from the state shown in FIG. 8, and the discharge port in a supply portion slides forward.
Figure 11:
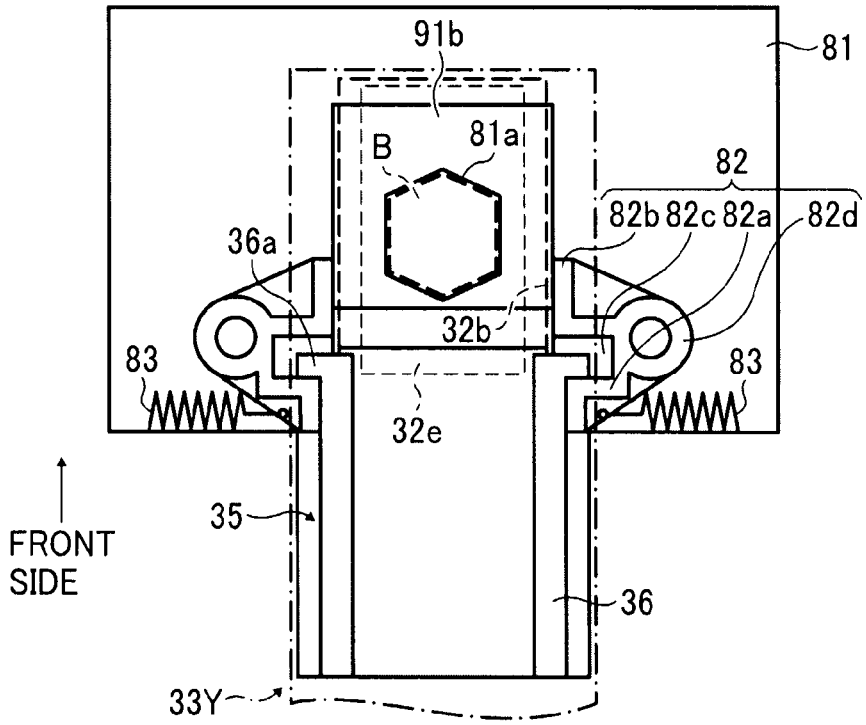
FIG. 11 is a plan view illustrating a state in which the toner bottle is set in the holder of the bottle frame shown in FIG. 4.
Figure 12:
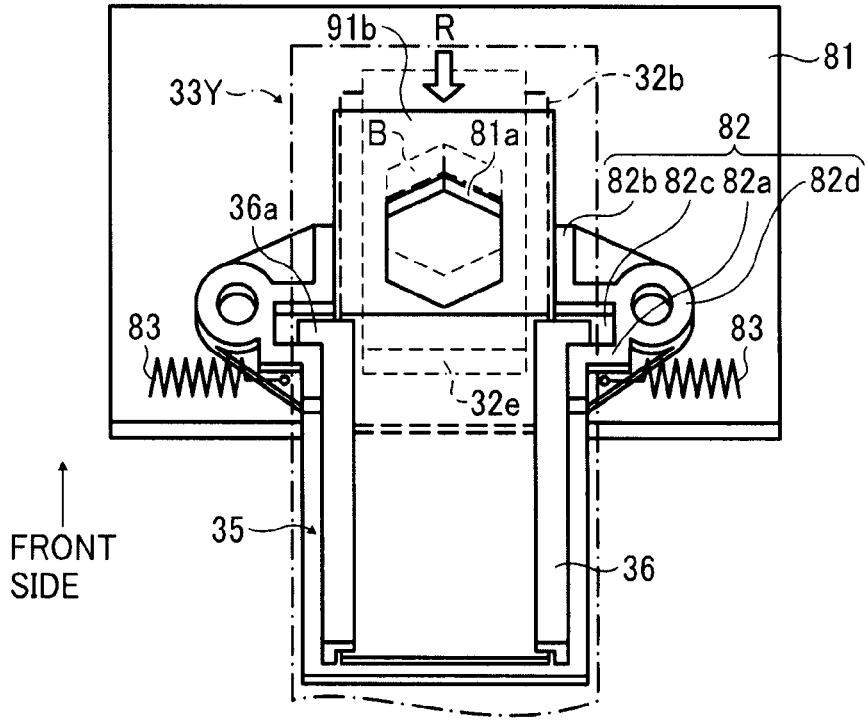
FIGS. 12 through 14 illustrate a process in which the toner bottle shown in FIG. 4 is released from the holder.
Figure 13:
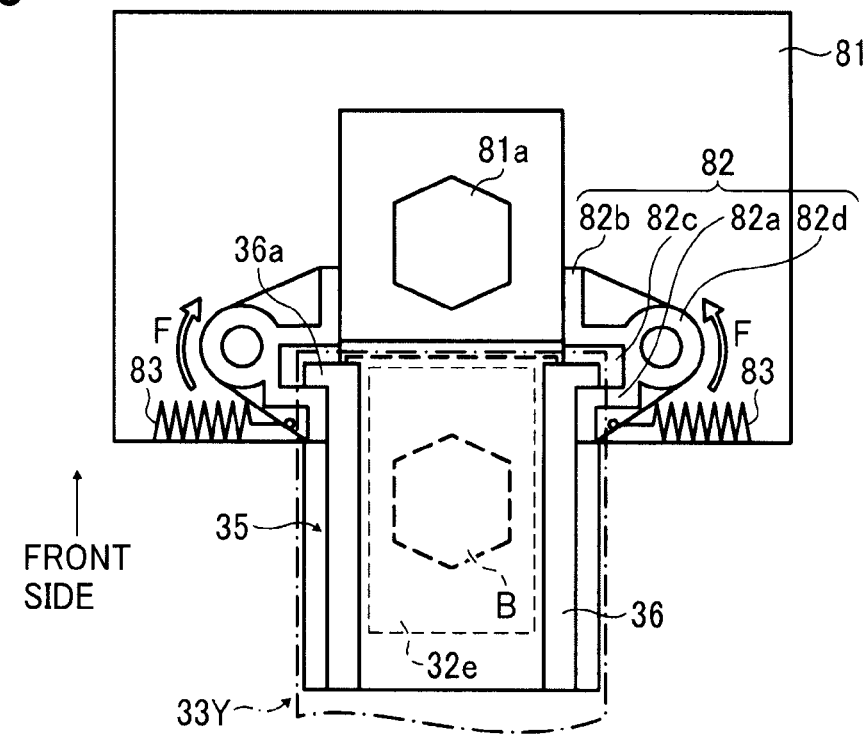
Figure 14:
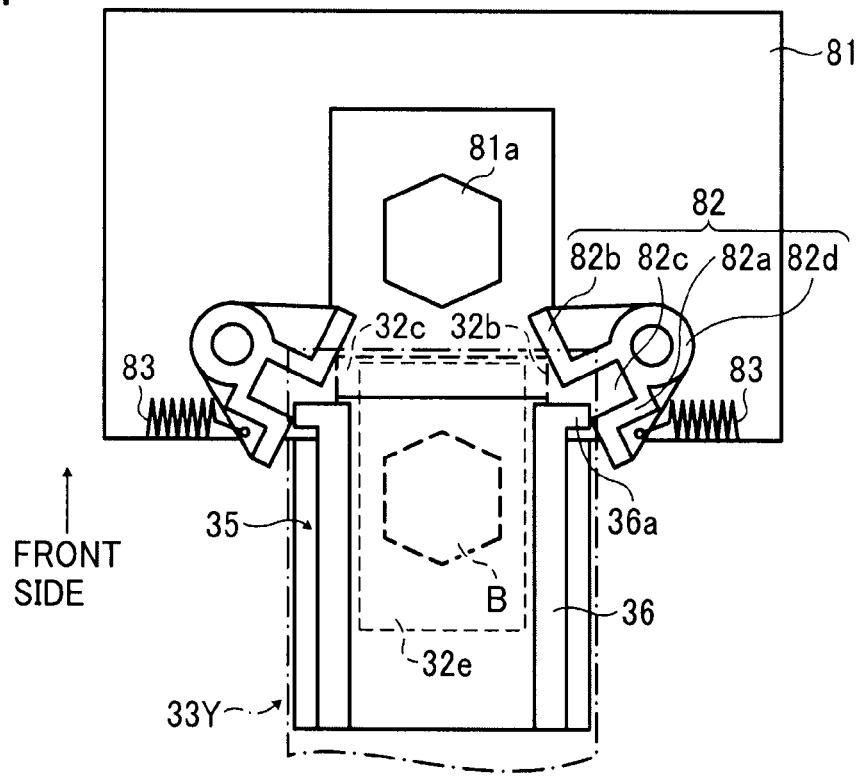

FIG. 10 is a plan view illustrating a state in which the toner bottle 32 is further pressed into the holder 81 from the state shown in FIG. 8, and the discharge port B in the supply portion 32*c* slides forward. FIG. 11 is a plan view illustrating a state in which the toner bottle 32Y is set in the holder 81 of the bottle frame 31 shown in FIG. 4, that is, a state (hereinafter "penetrating state") in which the discharge port B of the toner bottle 32Y overlaps the supply port 81*a* of the holder 81. FIGS. 12 through 14 illustrate a process in which the toner bottle 32Y is detached from the holder 81.

When the bottle body 33Y is further pressed into the bottle frame 31 from the state shown in FIG. 8 until the shutter member 35 contacts the part of the holder 81, the shutter member 35 cannot proceed any further. Therefore, the shutter member 35 stops in this position, and the supply portion 32*c* of the bottle body 33Y slides forward relatively to the shutter member 35. Then, the discharged port B of the toner bottle 32 is opened.

As described above, in the insertion process, after the shutter member 35 is stopped by the holder 81, the bottle body 33Y can further move in the direction of insertion, and thus, the toner discharge port B and the supply port 81*a* can be connected reliably as illustrated in FIG. 11.

Because the discharge port B of the toner bottle 32 is sealed by the sponge (seal member) 35*a* and the seal member 81*b* in the holder 81, leakage of the toner from the discharge port B can be prevented.

A series of movement when the toner bottle 32 is pulled out is described below with reference to FIGS. 12 through 14.

FIG. 12 is a plan view illustrating pulling out the toner bottle 32 inserted in the holder 81 (hereinafter "slide start state"). FIG. 13 is a plan view illustrating a state from which the shutter control member 82 is released. FIG. 14 is a plan view illustrating the shutter member 35 that is completely released. It is to be noted that, for simplicity, descriptions of the components disposed around the shutter control member shown in FIGS. 6 and 7 that are described above are omitted below.

While the toner bottle 32Y is pulled out, the shutter member 35 that is locked by the shutter control member 82 does not move, and only the bottle body 33Y of the toner bottle 32Y is moved in a direction in which the toner bottle 32Y is released (hereinafter "releasing direction"), indicated by an arrow R. Additionally, because the long arms 82*b* of the shutter control members 82 respectively contact both side surfaces of the toner bottle 32Y, that is, flat portion 32*b* (the supply portion 32*c*), the long arms 82*b* are restrained from rotating inward, and the short arms 82*a* are restrained from rotating outward. Thus, the shutter control member 82 is restrained from rotating in a direction indicated by an arrow F, that is, rotation of the shutter control member 82 in a direction in which the rail projection 36*a* is released is prevented.

The shutter member 35 blocks the discharge port B when the bottle body 33Y is moved in the releasing direction, and thereafter, the flat portion (side surface) 32*b* of the toner bottle 32Y that restrains the shutter control member 82 from moving is not present between the two sides of the long arm 82*b*. Therefore, the shutter control member 82 is rotated by the pulling spring 83 so as to return to the reset state shown in FIG. 7. Consequently, the rail projection 36*a* held in the recess 82*c* of the shutter control member 82 is flicked out by the return force. Due to this movement, the shutter member 35 closes the discharge port B, and coincidentally, the user can feel the click sensation that the rail projection 36*a* is snapped out from the recess 82*c* of the shutter control member 82. Therefore, the user can recognize that the toner bottle is detached from the bottle frame by receiving a tactile sensation through his/her hand to that effect.

After the shutter member 35 completely blocks the discharge port B, the toner bottle 32Y is pulled out from the bottle frame 31 as shown in FIG. 14. It is to be noted that, in the slide start state shown in FIG. 12, the sponge 35*a* disposed on the shutter member 35 closely contacts the bottom surface of the bottle body 33Y without a gap therebetween. Therefore, leakage of the toner from the discharge port B can be prevented while the bottle body 33 moves.

As described above, in the present embodiment, as a member to move the shutter member 35 in a direction in which the discharge port B is closed (hereinafter "closing direction"), instead of using elastic members (e.g., springs, etc.) provided on the shutter member 35 (toner bottle), the shutter control member 82 is provided in the bottle frame 31 so that the shutter member 35 is closed when the toner bottle 32Y is pulled out. The shutter control member 82 is rotatably attached to a main body of the toner supplying device 73. The shutter control members 82 closes the shutter member 35 by moving together with the toner bottle 32Y as the bottle body 33Y is pulled out.

Additionally, the bottle frame 31 includes the pair of shutter control members 82 that sandwich the two sides of one tip portion (e.g., rail projection 36*a*) of each shutter member 35, and the shutter member 35 can move a relatively long distance (hereinafter "movement distance") when opens and closes the toner discharge port B. Therefore, the toner discharge port B can be reliably opened and closed.

Therefore, in the present embodiment, the toner bottle can be inexpensive and can be more compact because no elastic member (e.g., spring) is provided on the toner bottle. Moreover, because the shutter member can open and close simultaneously with installation of the toner bottle, the powder supplying device can be inexpensive and more compact, and operational performance thereof can be improved. Furthermore, because the powder container (toner bottle 32) can move a distance longer than the movement distance of the shutter member 35 that opens and closes the discharge port B of the powder container (toner bottle 32), the shutter member 35 can securely close the discharge port B.

Accordingly, an image forming apparatus including the powder supplying device employing the bottle frame can be made more compact and inexpensive.

(Second Embodiment)

A second embodiment is described below, with reference to FIGS. 15A-18.

Figure 15A:
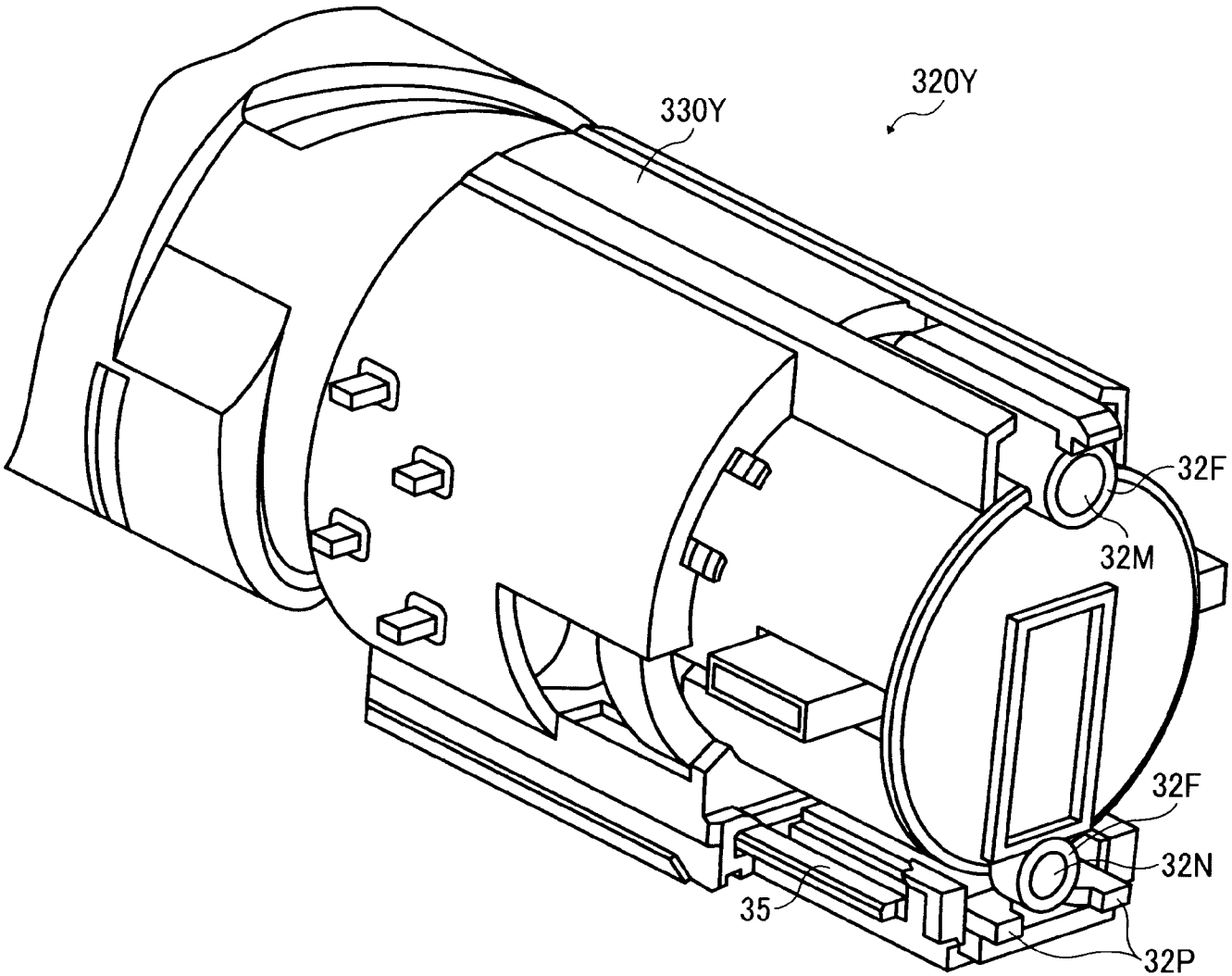
FIG. 15A is a schematic diagram illustrating a basic configuration of a toner bottle according to an another illustrative embodiment.
Figure 15B:
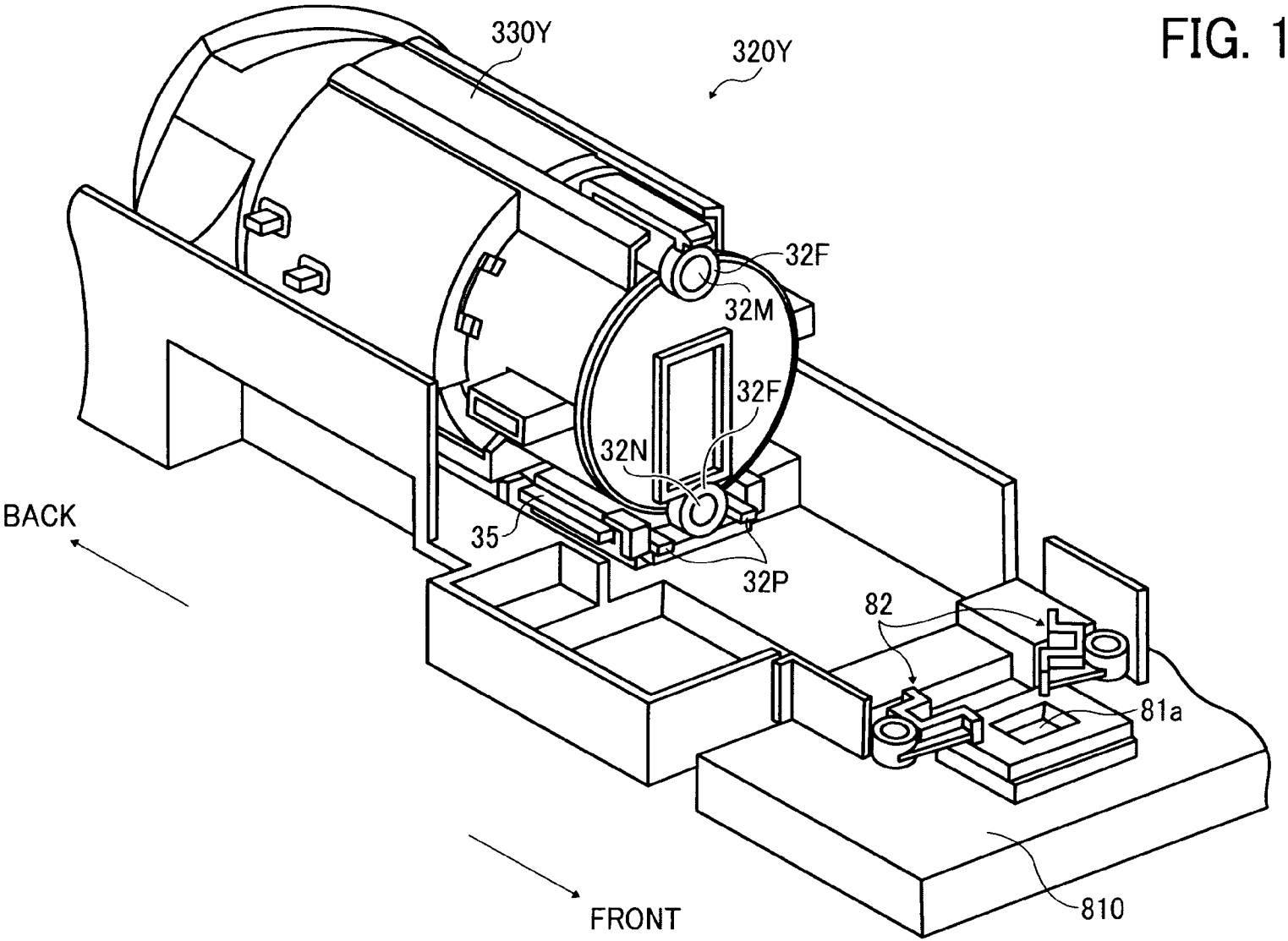
FIG. 15B is a schematic diagram illustrating a process in which the toner bottle shown in FIG. 15A is fitted into a powder supplying device.
Figure 16A:
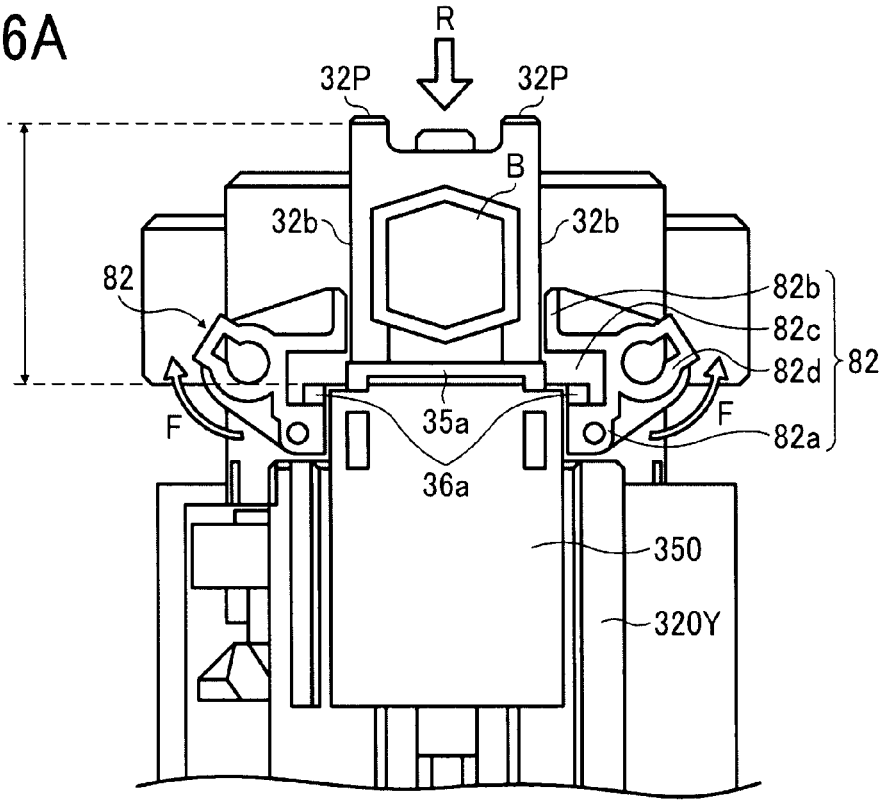
FIG. 16A is bottom view illustrating a state in which the toner bottle shown in FIG. 15A is set in the powder supplying device.
Figure 16B:
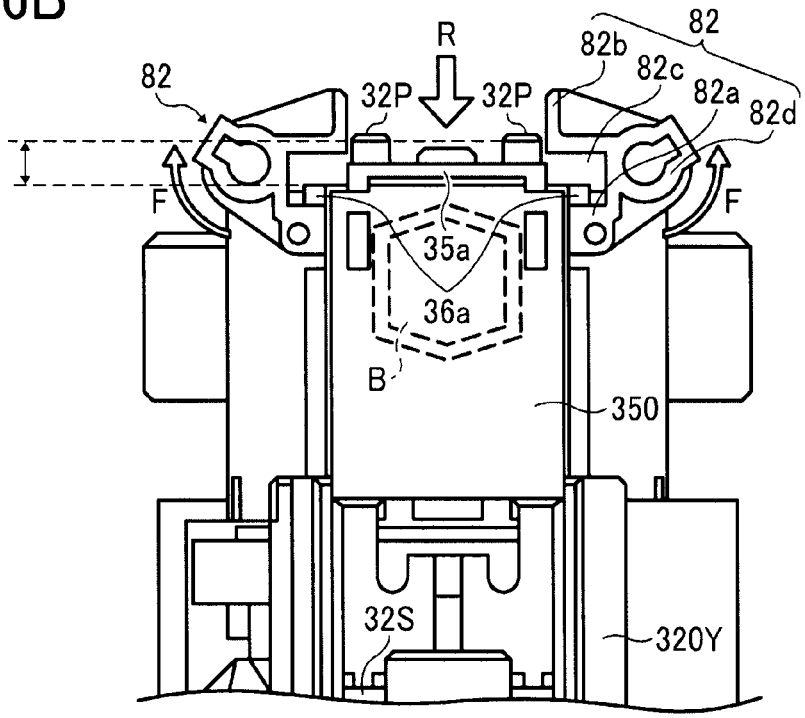
FIGS. 16B and 17 are bottom views illustrating a process in which the toner bottle is released from the powder supplying device.
Figure 17:
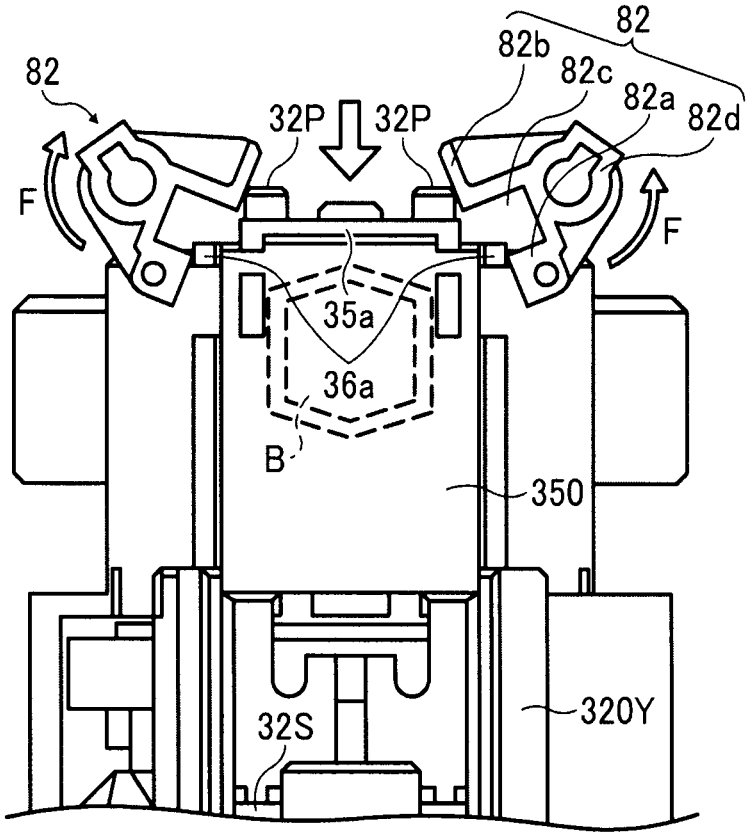
Figure 18:
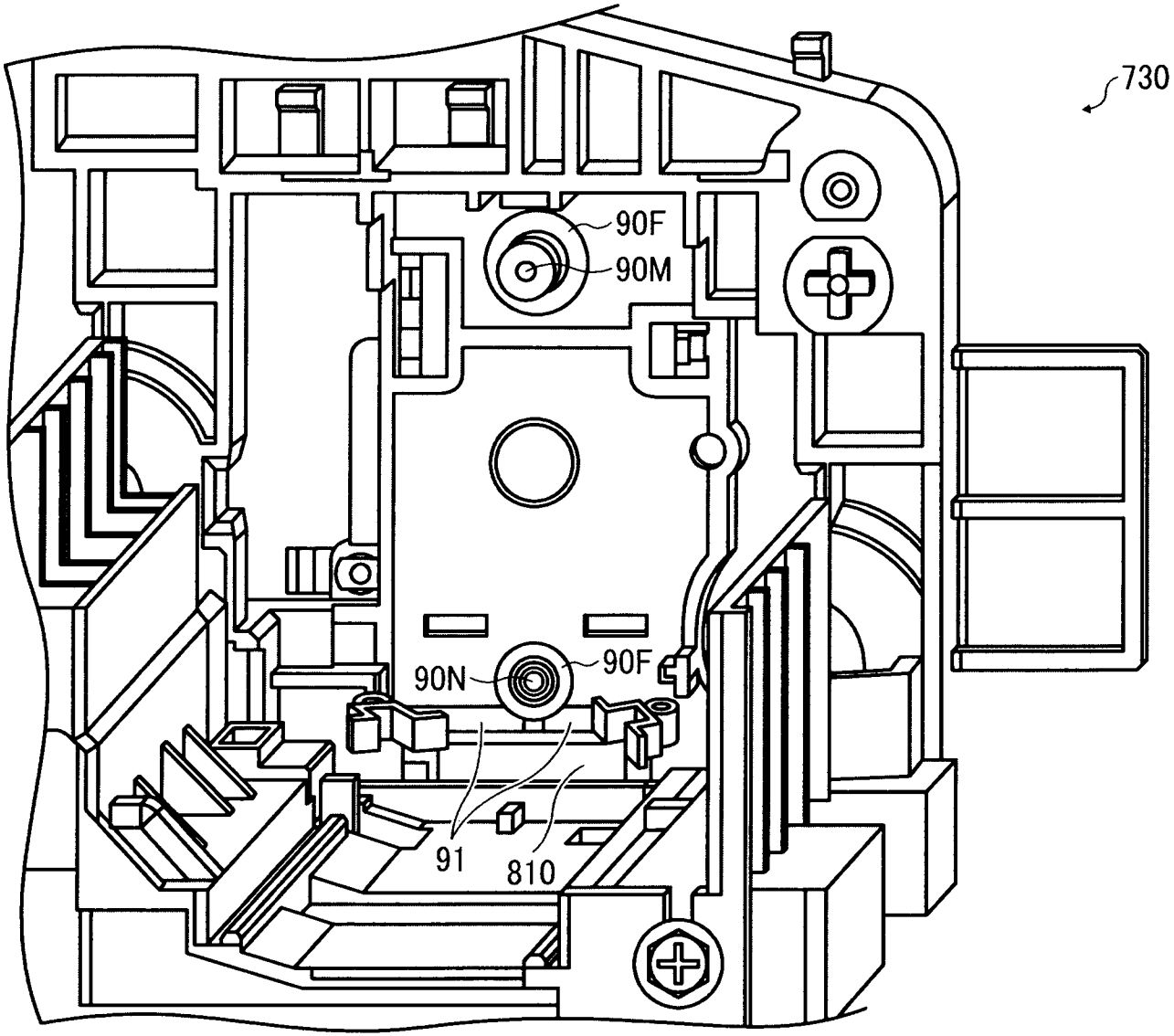
FIG. 18 is a diagram illustrating reference positions of a powder supplying device into which the toner bottle shown in FIGS. 15B and 15B is inserted.

FIG. 15A is a schematic diagram illustrating a basic configuration of a toner bottle 320Y according to the second embodiment. FIG. 15B is a schematic diagram illustrating a process in which the toner bottle 320Y is fitted into a powder supplying device 730. FIGS. 16A, 16B, and 17 are bottom views illustrating a process in which the toner bottle 320Y is released from the powder supplying device 730. FIG. 18 is a diagram illustrating reference positions of the powder supplying device 730.

It is to be noted that, for simplicity, descriptions of the components disposed around the shutter control member shown in FIGS. 6 and 7 that are described above are omitted below. Reference characters 32M and 32N shown in FIGS. 15A and 15B respectively represent reference holes in reference faces 32F, which are front surfaces of projections in which the references holes 32M and 32N are formed. The references holes 32M and 32N engage the reference projections 90M and 90N provided in the powder supplying device 730 shown in FIG. 18.

As shown in FIG. 15B, as the toner bottle 320Y is fitted into a holder 810 of the powder supplying device 730Y shown in FIG. 18, after a shutter member 350 is stopped in front of a supplying port 81*a*, only the toner bottle 320Y is further inserted in the direction of insertion. Thereby, the shutter member 350 stays back from a discharge port B in the direction of insertion, and the discharge port B of the toner bottle 320Y is opened relatively. Therefore, the discharge port B of the toner bottle 320Y is aligned with the supplying port 81*a*, and the toner in the toner bottle 320Y can be conveyed toward the toner supplying device 730.

A feature of the present embodiment is that the toner bottle 320Y has projection portions 32P that project forward to control shutter control members 82. As shown in FIG. 16A, the long arms 82*b* of the shutter members 82 contact both outer side surfaces 32*b* of the toner bottle 320Y, and an outer side surface of each projection portion 32P aligns with the outer surface 32*b* of the toner bottle 320Y. Each projection portion 32P is a member to restrain the shutter control members 82 from releasing the shutter 35, that is, the projection portion 32P extends a period during which the shutter control member 82 is open (shown in FIG. 16B) in order to avoid the shutter control member 82 from closing (shown in FIG. 17) too early.

When the toner bottle 320Y is inserted into the holder 810 of a toner supplying device 730 from the state shown in FIG. 15B, the long arm 82*b* is opened (shown in FIG. 16A), pressed by a tip portion of the shutter member 350, and when projection portion 36*a* is engaged with a recess 82*c* of the shutter control member 82 (shown in FIG. 16B), the long arm 82*b* holds the projection portion 36*a*.

If the projection portions 36P are not provided, as the toner bottle 320Y is released the shutter control member 82 remain in a hold state. That is, the shutter control member 82 holds the shutter member 350 only until a tip portion of the bottle body 330Y passes by the long arms 82*b*. The shutter control member 82 then releases the shutter member 350 when the toner bottle body 330Y passes by the shutter control member 82.

By contrast, in the present embodiment, because the toner bottle 320Y includes the projection portions 32P, the time period during which the shutter control members 82 hold the shutter member 350 can be increased by a time period corresponding to the length of the projection portion 32P, and therefore, the discharge port B is reliably closed by the shutter member 350.

That is, because the projection portions 32P project from a tip surface 350*b* of the shutter member 350, when the bottle body 330Y moves in the releasing direction shown in FIG. 16B from a state in which the bottle body 330 is fully set in the bottle frame 310 in the powder supplying device 730 shown in FIG. 16A and accordingly the shutter member 350 completely closes the discharge port B, the long arms 82*b* contact the side surfaces of the projection portions 32P after the tip surface 350*b* of the shutter member 350 passes by the long arms 82*b*.

When the projection portion 32P is not provided on the toner bottle 320Y as in the first embodiment, when the toner bottle 320Y is released, the long arm 82*b* that is pulled by the spring 83 is quickly released from both side surfaces of the toner bottle 320Y, and the long arms 82*b* release the rail projection 36*a* from the recess 82*c* of the shutter control member 82. Then, the rail projection 36*a* is disengaged from the shutter control member 82. Therefore, the bottle body 330Y including the supply portion 32*c* stops sliding relative to the motionless shutter member 350, and the shutter member 350 might be pulled out together with the bottle body 330Y. Consequently, the bottle body 330Y and the shutter member 350 might be pulled out before the shutter member 350 closes the discharge port B completely, and thus, it is possible that the toner leaks from the discharge port B.

In view of the foregoing, in the present embodiment, the projection portions 32P that project from the tip surface 320 of the bottle body 330Y is provided. Therefore, when the toner bottle 320Y is pulled out (as shown in FIGS. 16B and 17), the long arms 82*b* delay the release of the shutter control member 82 from the two sides 32*b* of the toner bottle 320Y. Therefore, the time period during which the long arms 82*b* contacts the both side surface 32*b* is lengthened. That is, the time when the rail projection portion 36*a* is disengaged from the recess 82*c* of the shutter control member 82 can be delayed. As a result, the long arms 82*b* hold the shutter member 350 until the shutter member 350 completely closes the discharged port B. This delay is accomplished by lengthening the distance by which the shutter member 350 moves relative to the toner bottle 320Y in the closing direction when the toner bottle 320Y is pulled out. Thus, improper opening and closing (particularly incomplete closing) of the discharge port can be prevented. Therefore, leakage of the toner can be prevented in the present embodiment.

It is to be noted that the number of the projection portions 32P that can extend a time during which the long arms 82*b* contact the both side surfaces 32*b* when the toner bottle 320Y is pulled out is the same as the number of the shutter control members 82. In the present embodiment, two shutter control members 82 are provided, and therefore, two projection portions 32P are provided. Because two shutter control member 82 are arranged symmetrically on both sides of the insertion route of the toner bottle, the shutter control members facing each other can move simultaneously.

Herein, because the toner bottle according to the present embodiment is compact, the discharge port B is located close to the tip portion of the toner bottle 320Y. Therefore, the shutter member 350 is provided in the tip portion of the toner bottle 320Y.

In a comparative configuration in which the projection portion 32P is provided in the tip portion of the shutter member 350 that is movable relative to the bottle body 330Y, the opening and closing of the discharge port B by the shutter member 350 may become unstable because a contact portion between the projection portion 32P and the shutter control member 82 may become unstable due to an accumulation of dimensional errors in member component manufacture as well as errors in assembly. In order to address this issue, the projection portion should be disposed on the bottle body as in the present embodiment.

Moreover, a movable area of the shutter member 350 can be restrained by stoppers, not shown, provided in the bottle body 330Y so that the shutter member 350 does not open. Referring to FIG. 17, because the shutter member 350 bumps shutter bumping portion 32S provided on the bottle portion of the toner bottle 320, supported by the stopper, the stoppers can prevent the shutter member 350 from moving toward the release position due to vibration during transport.

If the projection portion 32P is provided in the tip portion of the shutter member, then if the user hits the tip portion of the shutter member against another component while handling or fitting the toner bottle, the impulse can be transferred to the stopper or the shutter bumping portion 32S, thus damaging the stopper or the shutter bumping portion 32S.

By contrast, when the projection portion 32P is provided in the bottle body 330Y as in the present embodiment, because the projection portion 32P projects from the bottle body 330Y forward of the tip portion of the shutter member 350, at least the stopper can be protected by the projection portion 32P.

Next, the reference positions used when the toner bottle 320Y is fitted in the holder 810 are described below with reference to FIGS. 15A, 15B and 18.

As shown in FIGS. 15A and 15B, the reference hole 32M is formed in an upper portion of a front surface of the round bottle body 330Y, and the reference hole 32N is provided in a lower portion thereof. Further, as shown in FIG. 18, reference projections 90M and 90N that engage the respective reference holes 32M and 32N are provided on an inner surface of the toner supplying device 730.

In an insertion process of the toner bottle 320Y, initially, the position of the toner bottle 320Y is roughly determined relative to the toner supplying device 730 so that the reference projection 90M in the toner supplying device 730 engages the reference hole 32M in the toner bottle 320Y. Then, the toner bottle 320Y is pivoted around the reference projection 90M as an axis, and therefore, the position of the toner bottle 320Y is finally determined so that the reference projection 90N engages the reference hole 32N, thus completing the insertion process. That is, the positioning is completed when the reference faces 32F of the toner bottle 320Y closely contact reference faces 90F of the powder supplying device 730 by engaging the reference projections 90M and 90N with the respective reference holes 32M and 32N.

Herein, in the toner bottle 320Y and the powder supplying device 730 according to the present embodiment, the projection portion 32P that projects from the front surface 320 of the bottle body 330Y project forward from the reference face 32F. Therefore, if the projection portions 32P contact the powder supplying device 730 when the toner bottle 320Y has set in the powder supplying device 730, which disturbs the setting of the toner bottle 320Y.

To address this issue, escape portions 910 constituted as holes or concave portions is formed in the inner surface of the powder supplying device 730, in portions facing the projection portion 32P, and therefore, the projection portion 32P is fitted into the escape portion 910. More specifically, while the toner bottle 320Y is set into the bottle frame 310 in the powder supplying device 730, the projection portion 32P is provided forward from a reference face 90F in the powder supplying device 730. Therefore, improper positioning of the toner bottle that is caused by interference between the projection portion 32P and the inner surface of the powder supplying device 730 can be prevented.

Additionally, because the escape portions 91 are provided in the powder supplying device 730, the projection portions 32P can be located forward from the reference face 90F that is used in positioning the toner bottle 320Y relative to the toner supplying device 730, and the discharge portion B can be located as close to the front surface portion as possible. As a result, a wasted space between the discharge port and the reference faces 90F of the toner supplying device 730 can be eliminated or reduced. Therefore, the toner bottle can be made more compact or shorter.

In another comparative configuration in which the escape hole is not formed, as the discharge port is located farther from the reference faces 90F of the powder supplying device 730 when the toner bottle 320Y is fully installed, compared with the present embodiment, the space between the discharge port B and the reference face 90F is wasted. However, in the present embodiment, the issue can be addressed.

As described above, in the present embodiment, instead of an elastic material, the rotatable shutter control member 82 is provided in the powder supplying device 730 to bias the shutter member 350 in the direction to close discharge port B.

As described above, in the present embodiment, as a member to move the shutter member 350 in a direction in which the discharge port B is closed (hereinafter "closing direction"), instead of using elastic members (e.g., spring) provided on the shutter member 350 (toner bottle), the shutter control member 82 is provided in the bottle frame 310 so that the shutter member 350 is closed when the toner bottle 320Y is pulled out. The shutter control member 82 is rotatably attached to a side of a main body of the toner supplying device 730 shown in FIG. 18. The shutter control members 82 move in the closing direction to close the shutter member 350 simultaneously when the bottle body 330Y is pulled out.

Therefore, the toner bottle can be inexpensive and can be made more compact because the elastic member (e.g., spring) is not provided on the toner bottle. Moreover, because the shutter member can open and close simultaneously with installation of the toner bottle, the powder supplying device can be inexpensive and more compact, and operational performance thereof can be improved.

Additionally, in the present embodiment, because a projection portion 32P and reference holes 32M and 32N are further formed in the each of toner bottles 320 and the reference projections 90M and 90N and the escape portions 910 are further formed in the powder supplying device, the user can more easily install the toner bottle into the powder supplying device properly.

Numerous additional modifications and variations are possible in light of the above teachings. It is therefore to be understood that, within the scope of the appended claims, the disclosure of this patent specification may be practiced otherwise than as specifically described herein.

What is claimed is:

1. A powder supplying device comprising:
a powder container frame; and
a powder container, detachably installable in the powder container frame horizontally, including
a discharge port through which powder is discharged from the powder container; and
a shutter member attached to the powder container, to open and close the discharge port by moving along the powder container in a direction in which the powder container is installed;
the powder container frame including two shutter control members movably attached to the powder container frame,
the shutter control members opening and closing the shutter member by moving together with the powder container as the powder container is being inserted into and pulled out from the powder container frame, and sandwiching the shutter member from both sides, in a state in which the powder container is installed in the powder container frame and the shutter member is opened,
wherein the shutter control members are rotatable and opens and closes the shutter member by rotating together with the powder container as the powder container is inserted into and pulled out from the powder container frame.

2. The powder supplying device according to claim 1, wherein, when the powder container is fully installed, the shutter control members keep the powder container inserted in the powder container frame by holding a part of the shutter member.

3. The powder supplying device according to claim 2, wherein:
the shutter member of the powder container comprises two side projections to project outward from front ends of side faces of the shutter member, and
when the powder container is fully installed, the shutter control members keep the powder container inserted in the container frame by holding the side projections of the shutter member.

4. The powder supplying device according to claim 1, wherein each shutter control member comprises:
a first arm biased by a spring unidirectionally;
a second arm continuous with the first arm, to slidingly contact a side of the shutter member provided in the powder container when the powder container is installed and released;
and a rotary shaft disposed in a center portion thereof 5. The powder supplying device according to claim 1, wherein the powder container further comprises two projection portions provided in the powder container, to restrain the shutter control members from rotating in a direction to release the shutter member.

6. An image forming apparatus comprising:
an image carrier to carry a latent image;
a development device to develop the latent image formed on the image carrier with toner into a toner image;
a transfer device to transfer the toner image from the image carrier onto a recording medium;
a fixing device to fix the toner image on the recording medium with heat and pressure; and
a powder supplying device comprising:
a powder container frame; and
a powder container detachably installable in the powder container frame horizontally, including
a discharge port through which powder is discharged; and
a shutter member attached to the powder container, to open and close the discharge port by moving along the powder container in a direction in which the powder container is installed;
the powder container frame having two shutter control members movably attached to powder container frame,
the shutter control members opening and closing the shutter member by moving together with the powder container as the powder container is being inserted into and pulled out from the powder container frame, and sandwiching the shutter member from both sides, in a state in which the powder container is installed in the powder container frame and the shutter member is opened,
wherein the shutter control members open and close the shutter member by rotating together with the powder container as the powder container is inserted into and pulled out from the powder container frame.

7. A powder container detachably installable in a powder container frame having two shutter control members, the powder container comprising:
a discharge port through which powder is discharged from the powder container;
a shutter member attached to the powder container, to open and close the discharge port by moving along the powder container in a direction in which the powder container is installed, having two side projections to engage with the two shutter control members of the powder container frame when the powder container is installed in the powder container frame and the shutter member is sandwiched by the two control members; and
two projection portions to restrain the shutter control members from rotating in a direction to release the shutter member.

8. The powder container according to claim 7, wherein the two side projections of the shutter member project outward from front ends of side faces of the shutter member.

9. The powder container according to claim 7, further comprising:
toner within the powder container, wherein the powder is the toner.

10. A powder supplying device comprising:

a powder container frame, the powder container frame including two shutter control members movably attached to the powder container frame;

a powder container, detachably installable in the powder container frame horizontally, including a discharge port through which powder is discharged from the powder container;

a shutter member attached to the powder container, to open and close the discharge port by moving along the powder container in a direction in which the powder container is installed; and two projection portions to restrain the shutter control members from rotating in a direction to release the shutter member, the shutter control members opening and closing the shutter member by moving together with the powder container as the powder container is being inserted into and pulled out from the powder container frame, and sandwiching the shutter member from both sides, in a state in which the powder container is installed in the powder container frame and the shutter member is opened.

11. The powder supplying device according to claim 10, wherein the projection portions project from a front surface of the shutter member in a direction in which the powder container is installed.

12. The powder supplying device according to claim 10, wherein the projection portions project forward from a reference face in the powder supplying device when the powder container has been set in the powder container frame.

13. The powder container according to claim 10, further comprising:

toner within the powder container, wherein the powder is the toner.

14. A powder container detachably installable in a powder container frame having at least one shutter control member, the powder container comprising:

a discharge port through which powder is discharged from the powder container;

a shutter member attached to the powder container, to open and close the discharge port by moving along the powder container in a direction in which the powder container is installed, the shutter member including at least one side projection to engage with the at least one shutter control member of the powder container frame when the powder container is installed in the powder container frame; and at least one restraining portion to restrain the shutter control members from rotating in a direction to release the shutter member, wherein the at least one side projection includes two side projections.

15. The powder container according to claim 14, wherein the at least one restraining portion includes a projection portion.

16. The powder container according to claim 14, wherein the two side projections of the shutter member project outward from front ends of side faces of the shutter member.

17. The powder container according to claim 16, wherein the at least one restraining portion includes a projection portion.

18. The powder container according to claim 14, wherein the at least one restraining portion includes two flat surfaces on opposite sides of the powder container, corresponding to the two shutter control members, to restrain the corresponding shutter control members from rotating to release the shutter member.

19. The powder container according to claim 14, further comprising:

toner within the powder container, wherein the powder is the toner.

20. A powder container detachably installable in a powder container frame having two shutter control members, the powder container comprising:

a discharge port through which powder is discharged from the powder container;

a shutter member attached to the powder container, to open and close the discharge port by moving along the powder container in a direction in which the powder container is installed, the shutter member including two side projections, corresponding to the two shutter control members, to engage with the corresponding two shutter control members, when the powder container is installed in the powder container frame; and two flat surfaces on opposite sides of the powder container, corresponding to the two shutter control members, to restrain the corresponding shutter control members from rotating in a direction to release the shutter member.

21. The powder container according to claim 20, wherein the two side projections of the shutter member project outward in opposite directions from front ends of sides of the shutter member.

22. The powder container according to claim 20, further comprising:

two front projections which project along a length of the powder container from a front portion of the shutter member.

23. The powder container according to claim 20, further comprising:

toner within the powder container, wherein the powder is the toner.

* * * * *